US007243492B2

(12) United States Patent
Niidome et al.

(10) Patent No.: US 7,243,492 B2
(45) Date of Patent: Jul. 17, 2007

(54) INCLINED ROTATION CONTROL DEVICE OF VARIABLE DISPLACEMENT HYDRAULIC PUMP

(75) Inventors: Takashi Niidome, Tsuchiura (JP); Yoshitomo Yabuuchi, Chiyoda-machi (JP); Takeshi Kobayashi, Chiyoda-machi (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 9 days.

(21) Appl. No.: 10/558,703

(22) PCT Filed: Nov. 19, 2004

(86) PCT No.: PCT/JP2004/017642

§ 371 (c)(1),
(2), (4) Date: Nov. 29, 2005

(87) PCT Pub. No.: WO2005/066490

PCT Pub. Date: Jul. 21, 2005

(65) Prior Publication Data

US 2007/0017219 A1 Jan. 25, 2007

(30) Foreign Application Priority Data

Jan. 5, 2004 (JP) ..... 2004-000529

(51) Int. Cl.
*F04B 1/32* (2006.01)
*F16H 61/42* (2006.01)

(52) U.S. Cl. ..... 60/443; 91/359

(58) Field of Classification Search ..... 60/443; 91/359, 388, 505
See application file for complete search history.

(56) References Cited

U.S. PATENT DOCUMENTS

| | | | | |
|---|---|---|---|---|
| 4,205,590 | A * | 6/1980 | Stegner | 91/359 |
| 4,355,506 | A * | 10/1982 | Leonard | 60/443 |
| 4,518,320 | A * | 5/1985 | Goodell | 60/443 |
| 5,160,245 | A * | 11/1992 | Geringer | 91/506 |
| 5,207,751 | A * | 5/1993 | Suzuki et al. | 60/443 |
| 6,623,247 | B2 * | 9/2003 | Du | 91/505 |

FOREIGN PATENT DOCUMENTS

| | | |
|---|---|---|
| JP | 49-10696 | 3/1974 |
| JP | 5-39863 | 2/1993 |
| JP | 11-351134 | 12/1999 |
| JP | 2003-74461 | 3/2003 |

* cited by examiner

*Primary Examiner*—Thomas E. Lazo
(74) *Attorney, Agent, or Firm*—Mattingly, Stanger, Malur & Brundidge, P.C.

(57) ABSTRACT

A motion converting section (31) and a translation bar (33) of a feedback mechanism (30) are provided between a lateral side of a swash plate (21) and a control sleeve (26) of a regulator (24). When the swash plate (21) is in a neutral position, the motion converting section (31) is located in an initial position (F—F) at one end of axial direction along an axis line (O—O) passing through a tilting center (C) of tilting motions, and, when the swash plate (21) is driven to tilt in a forward or reverse direction, displaced to the other end of axial direction along the axis line (O—O) to convert a tilting motion of the swash plate (21) into an axial displacement. Through the translation bar (33), the axial displacement is transmitted to the control sleeve (26) of the regulator (24) as an axial displacement.

10 Claims, 24 Drawing Sheets

INCLINED ROTATION CONTROL DEVICE OF VARIABLE DISPLACEMENT HYDRAULIC PUMP

TECHNICAL FIELD

This invention relates to a tilting controller for a variable displacement hydraulic pump suitable for use, for example, on a working vehicle such as wheel loader, wheel type hydraulic excavator or hydraulic crane or crawler type hydraulic excavator or hydraulic power crane.

BACKGROUND ART

Generally, construction machines like hydraulic excavators are provided with a variable displacement hydraulic pump which constitutes a pressure oil source along with a tank. A rotational shaft of a variable displacement hydraulic pump of this sort is driven from a prime mover like a Diesel engine to supply pressure oil to and from various hydraulic actuators such as working hydraulic cylinders, a vehicle drive hydraulic motor or a revolving hydraulic motor.

There has conventionally been known a variable displacement hydraulic pump of this sort (hereinafter referred to as a first prior art) which is provided with a tilting controller, including tilting actuators to which a tilting control pressure is supplied to drive tilting motions of a volume varying portion of the hydraulic pump, a regulator in the form of a servo valve having a spool within a control sleeve for controlling the tilting control pressure to be supplied to and from the tilting actuators according to a command signal from outside, and a feedback mechanism which is adapted to follow tilting motions of the volume varying portion for feedback control of the control sleeve of the regulator (e.g., Japanese Patent Laid-Open No. 2003-74461).

In the case of the tilting controller just mentioned, as the spool of the regulator is put in a sliding displacement in response to a command signal from outside, the tilting control pressure is switched to let the tilting actuators drive the volume varying portion. The feedback mechanism is arranged, for example, to turn a feedback link, following tilting motions of the volume varying portion. Further, by transmission of a rotational displacement of the feedback link, the control sleeve of the regulator is put in a sliding displacement in the same direction as the spool for the sake of feedback control.

On the other hand, as a second prior art, there has also been known a tilting controller for a variable displacement hydraulic pump, which is arranged for application exclusively to a closed hydraulic circuit (e.g., Japanese Patent Laid-Open No. H5-39863).

In the case of the tilting controller employed in the variable displacement hydraulic pump by the above-mentioned first prior art, a volume varying portion of the hydraulic pump is driven to tilt only in one direction (e.g., in a normal or forward direction), for example, in reference to a zero angle neutral position, without taking into account tilting motions in a reverse direction from the neutral position.

Therefore, in order to connect the variable displacement hydraulic pump to a hydraulic actuator like a hydraulic motor through a closed hydraulic circuit, drastic restructuring becomes necessary for driving the volume varying portion to tilt in both forward and reverse directions from the neutral position.

Besides, when applied to a closed hydraulic circuit, the control sleeve of the regulator has to be fed back (put in sliding displacements) in both forward and reverse directions as the volume varying portion is tilted in forward and reverse directions, and this makes smooth feedback control of the regulator difficult.

On the other hand, in the case of the tilting controller of the variable displacement hydraulic pump by the second prior art which is intended specifically for use with a closed hydraulic circuit, a tilting actuator which drives a volume varying portion of the hydraulic pump is assembled integrally with a volume control valve.

More particularly, in this case of the tilting controller, main spools and pressure chambers are provided on the opposite sides of a regulator piston which functions as a tilting actuator, necessitating an increased number of component parts due to complicate construction of the controller as a whole.

Besides, in this case, the tilting controller which is constructed exclusively for use with a closed hydraulic circuit is too limited in versatility to exclude applications to an open hydraulic circuit, that is to say, can find only limited applications as a hydraulic pump.

DISCLOSURE OF THE INVENTION

In view of the above-discussed problems with the prior art, it is an object of the present invention to provide a tilting controller for a volume varying portion, which can drive a volume varying portion to tilt in both forward and reverse directions to permit application to a closed hydraulic circuit and which is capable of smooth feedback control of a regulator, despite simplification in construction.

It is another object of the present invention to provide a tilting controller for a variable displacement hydraulic pump, which not only can be connected to a hydraulic actuator of a hydraulic motor by the use of a closed hydraulic circuit but can be applied to an open hydraulic circuit, succeeding in attaining higher versatility of application and higher productivity while cutting a production cost.

(1) According to the present invention, in order to achieve the above-stated objectives, there is provided a tilting controller for a variable displacement hydraulic pump, including a variable displacement hydraulic pump having a volume varying portion in association with a rotational shaft rotationally driven by a drive source, tilting actuators adapted to be applied with a tilting control pressure for driving the volume varying portion of the hydraulic pump into a tilted position, a regulator in the form of a servo valve having a spool within a control sleeve for generating the tilting control pressure to be fed to and from the tilting actuators according to a command signal from outside, and a feedback mechanism adapted to follow tilting motions of the volume varying portion to feed back the control sleeve of the regulator.

The tilting controller according to the invention is characterized in that the volume varying portion of the hydraulic pump is tiltable in both forward and reverse directions from a zero angle neutral position driven by the tilting actuators; the feedback mechanism is constituted by a motion converting section adapted to convert a tilting motion of the volume varying portion into a longitudinal linear displacement along a straight line passing a tilting center of the volume varying portion, and a displacement transmission member located between the motion converting section and the control sleeve of the regulator to transmit the longitudinal linear displacement converted by the motion converting section to the control sleeve of the regulator; and the motion converting section being located in an initial position at one end of longitudinal direction along the straight line when the volume varying portion is in a neutral position, and being displaced along and toward the other end of longitudinal direction along the straight line from the initial position when the volume varying portion is driven to tilt in forward or reverse direction.

As described above, according to the present invention, by means of tilting actuators, a volume varying portion of a hydraulic pump in a neutral position can be driven to tilt in both forward and reverse directions. Therefore, when the volume varying portion is tilted in a forward direction, for example, pressure oil can be supplied from the hydraulic pump to a hydraulic actuator in one direction through a closed hydraulic circuit. On the other hand, when the volume varying portion is tilted in a reverse direction, pressure oil can be supplied from the hydraulic pump to a hydraulic actuator in the opposite direction (reverse direction). Besides, the feedback mechanism is constituted by a motion converting section and a displacement transmission member, and, when the volume varying portion is in a zero angle neutral position, the motion converting section of the feedback mechanism is located at an initial position at one end of longitudinal direction along a straight line passing through a tilting center of the volume varying portion. When the volume varying portion is driven into a tilted position in forward or reverse direction, a tilting motion of the volume varying portion is converted into a longitudinal linear displacement along the above-mentioned straight line, that is to say, into a longitudinal linear displacement toward the other end of longitudinal direction from the initial position. The linear displacement is transmitted from the displacement transmission member to the control sleeve of the regulator, putting the control sleeve in a sliding displacement in the same direction of a spool to feed back the regulator.

Therefore, even in a case where the hydraulic pump is connected to a hydraulic actuator through a closed hydraulic circuit, the volume varying portion can be tilted in both forward and reverse directions to control the delivery rate (flow rate) of pressure oil in both directions, under smooth feedback control of the regulator no matter whether the volume varying portion is tilted in forward or reverse direction. Since the regulator can be constituted by a servo valve having a spool within a control sleeve, the tilting controller as a whole can be simplified in construction. Further, the hydraulic pump can also be applied to an open hydraulic circuit for supplying pressure oil to and from a hydraulic actuator. Namely, the hydraulic pump is of a versatile build which can be applied to both closed hydraulic circuits and open hydraulic circuits, and which can contribute to enhance productivity and to cut production cost.

(2) In this instance, the above-mentioned straight line extends parallel with an axis line of the rotational shaft of the hydraulic pump, and the motion converting section is adapted to convert a tilting motion of the volume varying portion into an axial displacement along the direction of the axis line of the rotational shaft.

With the arrangements just described, by the motion converting section of the feedback control mechanism, a tilting motion of the volume varying portion can be converted into an axial displacement along the direction of the axis line of the rotational shaft of the hydraulic pump. When the volume varying portion is in the neutral position, for example, the displacement transmission member of the feedback mechanism is located in the initial position at one end of axial direction long the direction of the rotational shaft of the hydraulic pump, and, when the volume varying portion is driven to tilt in forward or reverse direction, the displacement transmission member can be displaced axially from the initial position toward the other end of axial direction.

(3) Further, in another preferred form of the present invention, the above-mentioned straight line is an inclined straight-line drawn at a predetermined angle relative to the rotational shaft of the hydraulic pump, and the motion converting section is adapted to convert a tilting motion of the volume varying portion into a longitudinal linear displacement in the direction of the inclined straight line.

With the arrangements just described, by the motion converting section of the feedback mechanism, a tilting motion of the volume varying portion is converted into a longitudinal linear displacement along the inclined straight line. When the volume varying portion is in a neutral position, for example, the displacement transmission member of the feedback mechanism is located in an initial position at one end of a longitudinal direction along the inclined straight line, and, when the volume varying portion is driven to tilt in forward or reverse direction, the displacement transmission member is displaced from the initial position toward the other end of the longitudinal direction.

(4) On the other hand, according to the present invention, a directional control valve is provided between the tilting actuators and the regulator to switch direction of supply of the tilting control pressure for driving to tilt the volume varying portion in forward or reverse direction from a neutral position.

With the arrangements just described, the direction of tilting control pressure supply can be changed over from direction to another by switching the position of the directional control valve which is provided between the tilting actuators and the regulator, and the volume varying portion can be tilted in both forward and reverse direction from the neutral position according to a tilting control pressure. Besides, the construction of the tilting controller including the regulator can be simplified from the standpoint of enhancing productivity and cutting the production cost.

(5) Further, according to the present invention, the displacement transmission member of the feedback mechanism is constituted by a translation member adapted to be put in a rectilinear movement in the longitudinal direction of the straight line together with the control sleeve of the regulator, following a tilting motion of the volume varying portion.

With the arrangements just described, in consequence of a tilting motion of the volume varying portion an axial displacement translated by the motion converting section is transmitted to the control sleeve of the regulator as a rectilinear movement of a translation member in the longitudinal direction of the straight line, permitting smooth feedback control of the control sleeve.

(6) Further, according to the present invention, the motion converting section of the feedback mechanism is constituted by an active coupling member provided at a lateral side of the volume varying portion at a position spaced from a tilting center of the volume varying portion, and a passive coupling member provided at one longitudinal end of the displacement transmission member extended in a perpendicularly intersecting direction relative to the straight line and held in sliding engagement with the active coupling member.

In a case where the motion converting section of the feedback mechanism is constituted by an active coupling member which is provided at a lateral side of the volume varying portion, and a passive coupling member which is provided at one longitudinal end of a displacement transmission member, a tilting motion of the volume varying portion can be converted into a rectilinear movement (a longitudinal linear displacement) of the displacement transmission member.

(7) Further, in this case, the active coupling member of the motion converting section is constituted by a projection provided on the volume varying portion to extend in a radial direction relative to the straight line, and the passive coupling member is constituted by a slider portion of U-shape in cross section slidably held in fitting engagement with the projection and extended in a perpendicularly intersecting direction relative to the straight line.

In this manner, by holding the projection slidably in fitting engagement with the slider portion of U-shape in cross section, one end of the displacement transmission member can be restricted of movements relative to the volume varying portion in the longitudinal direction of the above-mentioned straight line, but relative movements of the slider portion and the volume varying portion are permitted in a direction perpendicular to the straight line to pick up smoothly tilting motions of the volume varying portion.

(8) Further, according to the present invention, the motion converting section of the feedback mechanism is constituted by a tilting lever extended from the volume varying portion in the longitudinal direction of the straight line for tilting integrally with the volume varying portion, an active coupling member provided on the tilting lever at a position spaced from a tilting center of the volume varying portion, and a passive coupling member provided at one longitudinal end of the displacement transmission member to extend in a perpendicularly intersecting direction relative to the straight line and held in sliding engagement with the active coupling member.

With the arrangements just described, a tilting motion of the volume varying portion can be converted into a longitudinal linear displacement of the displacement transmission member on a magnified scale depending upon the length of a hand of the tilting lever, making it possible to transmit a tilting motion of the volume varying portion to the control sleeve of the regulator on a magnified scale.

(9) In this instance, preferably the active coupling member of the motion converting section is constituted by a projection provided on the tilting lever in a radial direction relative to the straight line, and the passive coupling member is constituted by a slider portion of U-shape in cross section slidably held in fitting engagement with the projection and extended in a perpendicularly intersecting direction relative to the straight line.

(10) On the other hand, according to the present invention, the displacement transmission member of the feedback mechanism is constituted by a support shaft extended in a direction perpendicular to the straight line, and a rocking link having a longitudinally intermediate portion thereof rockably supported on the support shaft to displace the control sleeve of the regulator in a longitudinal direction following a tilting motion of the volume varying portion.

In a case where a rocking link is employed in this manner, a tilting motion of the volume varying portion is converted into a longitudinal displacement in the opposite direction by the motion converting section, and it can be transmitted to the control sleeve of the regulator as a displacement in the opposite direction. Nevertheless, even in this case, the control sleeve is displaced in the same direction as the spool by the feedback control of the regulator. Further, in this case, as the one end and the other end of the rocking lever are turned about the support shaft, they are displaced in opposite directions. Therefore, the dimension of a displacement of the control sleeve can be magnified depending upon the ratio of a dimension (the ratio of a length) from the support shaft to the both ends of the rocking lever. Accordingly, displacements can be fed back to the control sleeve of the regulator on a sufficiently enlarged scale.

(11) Further, according to the present invention, the motion converting section of the feedback mechanism is constituted by an active coupling member provided at a lateral side of the volume varying portion at a position spaced from a tilting center of the volume varying portion, and a passive coupling member provided at one longitudinal end of the rocking link extended in a perpendicularly intersecting direction relative to the straight line and held in slidable engagement with the active coupling member. In this case, a tilting motion of the volume varying portion is picked up as a rocking displacement of the rocking link (a rocking displacement in the longitudinal direction of the above-mentioned straight line).

(12) Even in the foregoing case, the active coupling member of the motion converting section is constituted by a projection provided on the volume varying portion in a radial direction relative to the straight line, and the passive coupling member is constituted by a slider portion of U-shape in cross section slidably held in fitting engagement with the projection and extending in a perpendicularly intersecting direction relative to the straight line.

(13) On the other hand, according to the present invention, the control sleeve and spool of the regulator are disposed to extend parallel with the straight line, and the displacement transmission member is fixedly anchored to the control sleeve.

In this case, for example, the translation member which is provided between the control sleeve of the regulator and the volume varying portion (or the tilting lever) can be smoothly displaced in the longitudinal direction of the above-mentioned straight line, following a tilting motion of the volume varying portion to realize smooth feedback control of the control sleeve of the regulator.

(14) Further, according to the present invention, the hydraulic pump is comprised of a tubular casing rotatably supporting the rotational shaft, a cylinder block provided in the casing for rotation integrally with the rotational shaft and containing a plural number of cylinders which extend in axial direction at spaced positions in circumferential direction, a plural number of pistons fitted in the cylinders of the cylinder block for reciprocating movements therein, and a swash plate having a sliding surface for a shoe attached to an end of each piston and tiltably mounted in the casing to constitute the volume varying portion; the tilting actuators are located in the casing at a spaced position from the rotational shaft in radially direction and having tilting pistons for driving the swash plate in a neutral position to tilt in a forward or reverse direction; the regulator is provided in the casing at a spaced position from the tilting pistons, with the control sleeve coupled with the swash plate through the feedback mechanism; and an intermediate portion of the displacement transmission member of the feedback mechanism is mounted on the casing in such a way as to permit displacements along the longitudinal direction of the straight line.

With the arrangements just described, even in a case where the swash plate type variable displacement hydraulic pump is connected to a hydraulic actuator through a closed hydraulic circuit, the swash plate can be tilted in forward and reverse directions from a zero angle neutral position, permitting to control the delivery rate (flow rate) of pressure oil in both directions and feeding back the regulator smoothly no matter whether a tilting motion of the swash plate is in a forward direction or in a reverse direction.

BEST MODE FOR CARRYING OUT THE INVENTION

Figure 1:
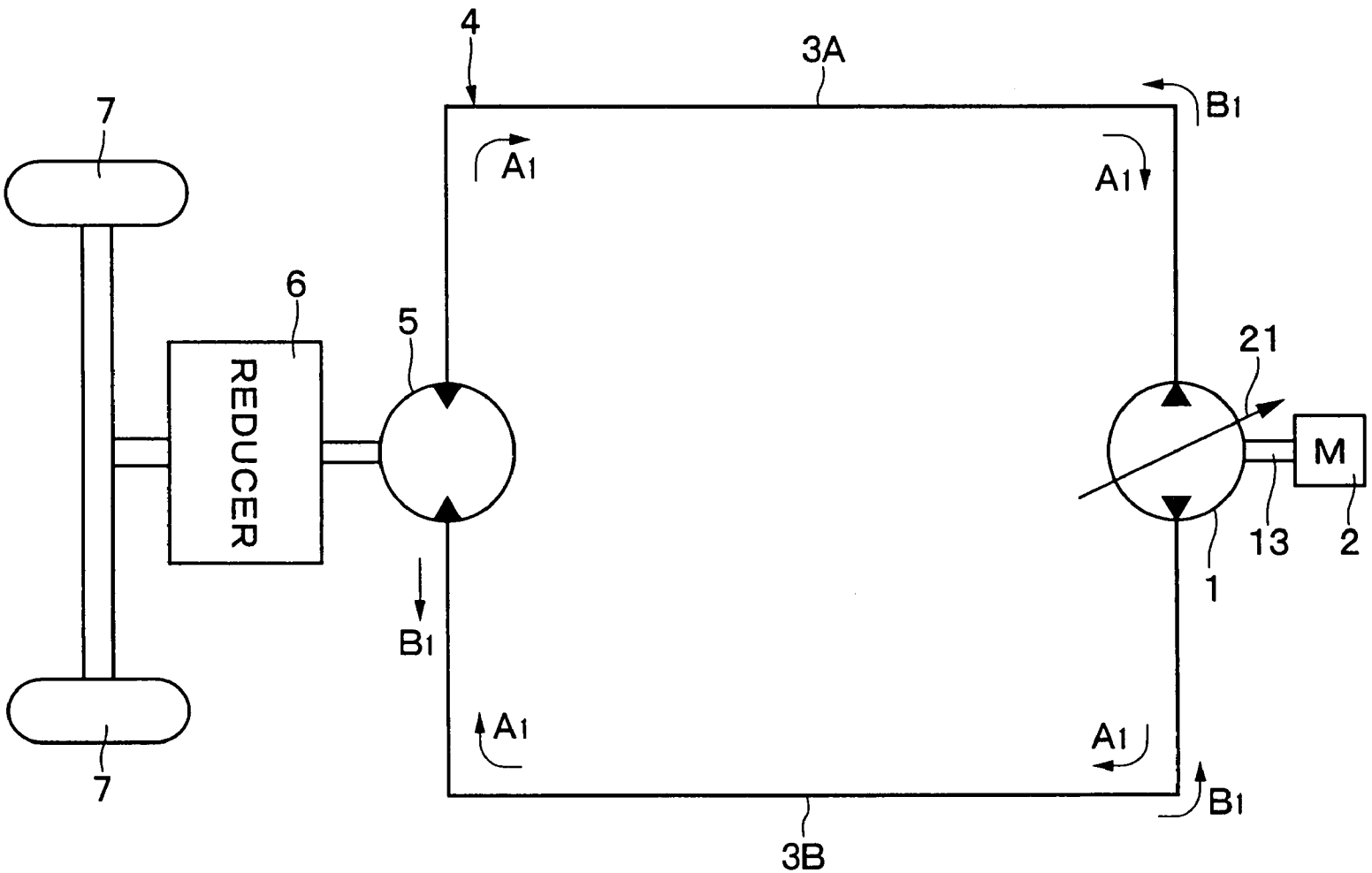
FIG. 1 is a circuit diagram of a closed hydraulic circuit incorporating a variable displacement hydraulic pump according to a first embodiment of the present invention.

Hereafter, with reference to FIGS. 1 through 23, the tilting controller of a variable displacement hydraulic pump according to the present invention is described more particularly by way of its preferred embodiments which are applied by way of example to a vehicle drive hydraulic circuit of a wheel type working vehicle like a wheel loader.

Shown in FIGS. 1 through 9 is a first embodiment of the present invention. In these figures, indicated at 1 is a swash plate type variable displacement hydraulic pump as a variable displacement hydraulic pump. The hydraulic pump 1 is constituted by a casing 11, rotational shaft 13, cylinder block 14, valve plate 19 and swash plate 21, which will be described hereinafter.

Further, the hydraulic pump 1 is rotationally driven from a prime mover 2 like a Diesel engine which is coupled with a rotational shaft 13 as a drive source to supply pressure oil to a pair of main conduits 3A and 3B. Through the main conduits 3A and 3B, the hydraulic pump 1 is connected to a hydraulic motor 5, which will be described hereinafter, forming a so-called closed hydraulic circuit 4.

Indicated at 5 is a vehicle driving hydraulic motor as a hydraulic actuator. This hydraulic motor 5 is coupled, for example, with wheels 7 of a wheel type working vehicle through a reducer 6. As pressure oil is fed to and from the hydraulic pump 1 through the main conduits 3A and 3B, the wheels 7 are rotationally driven from the hydraulic motor 5 to put the working vehicle in travel.

Figure 2:
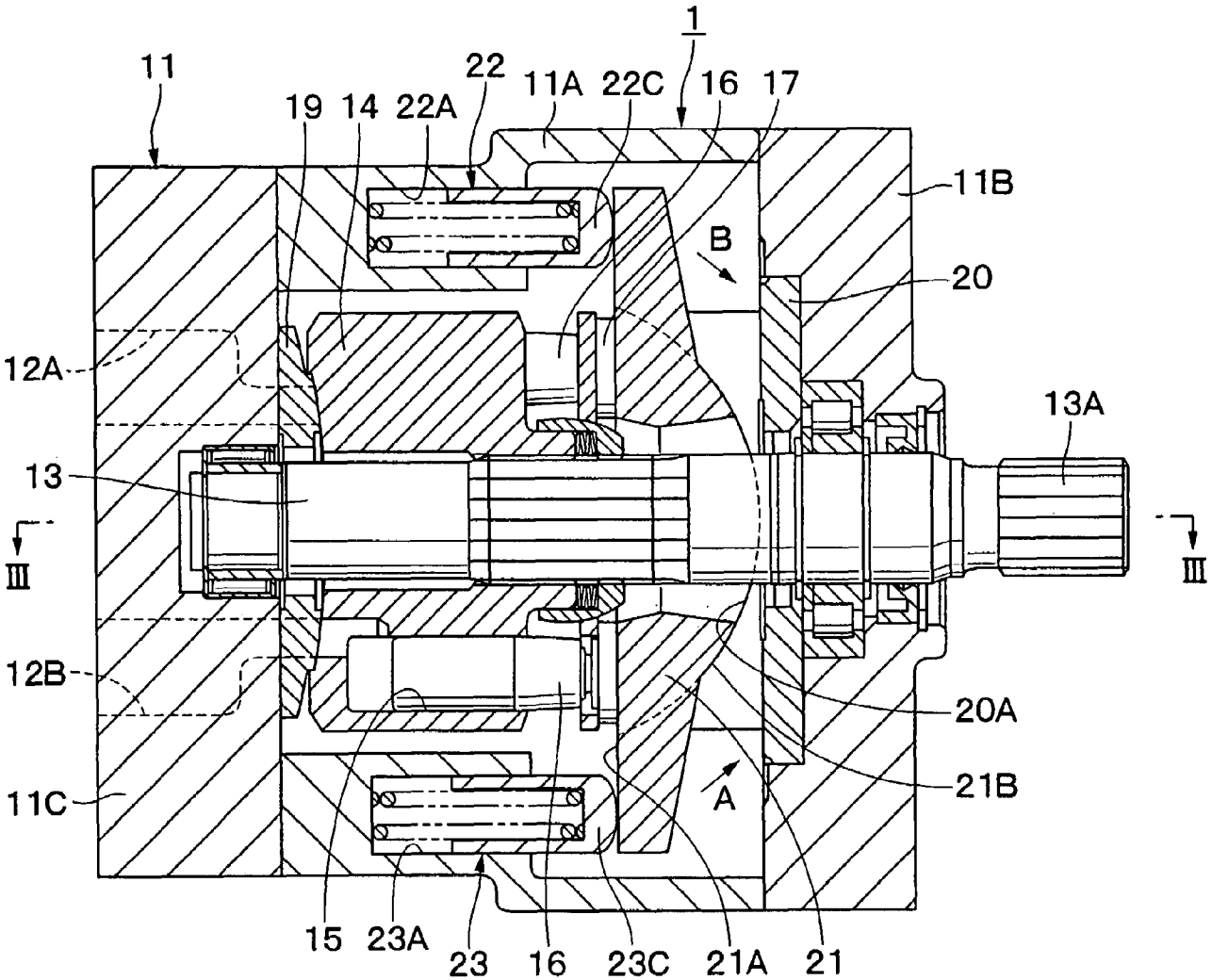
FIG. 2 is a vertical sectional view of the hydraulic pump shown in FIG. 1.
Figure 3:
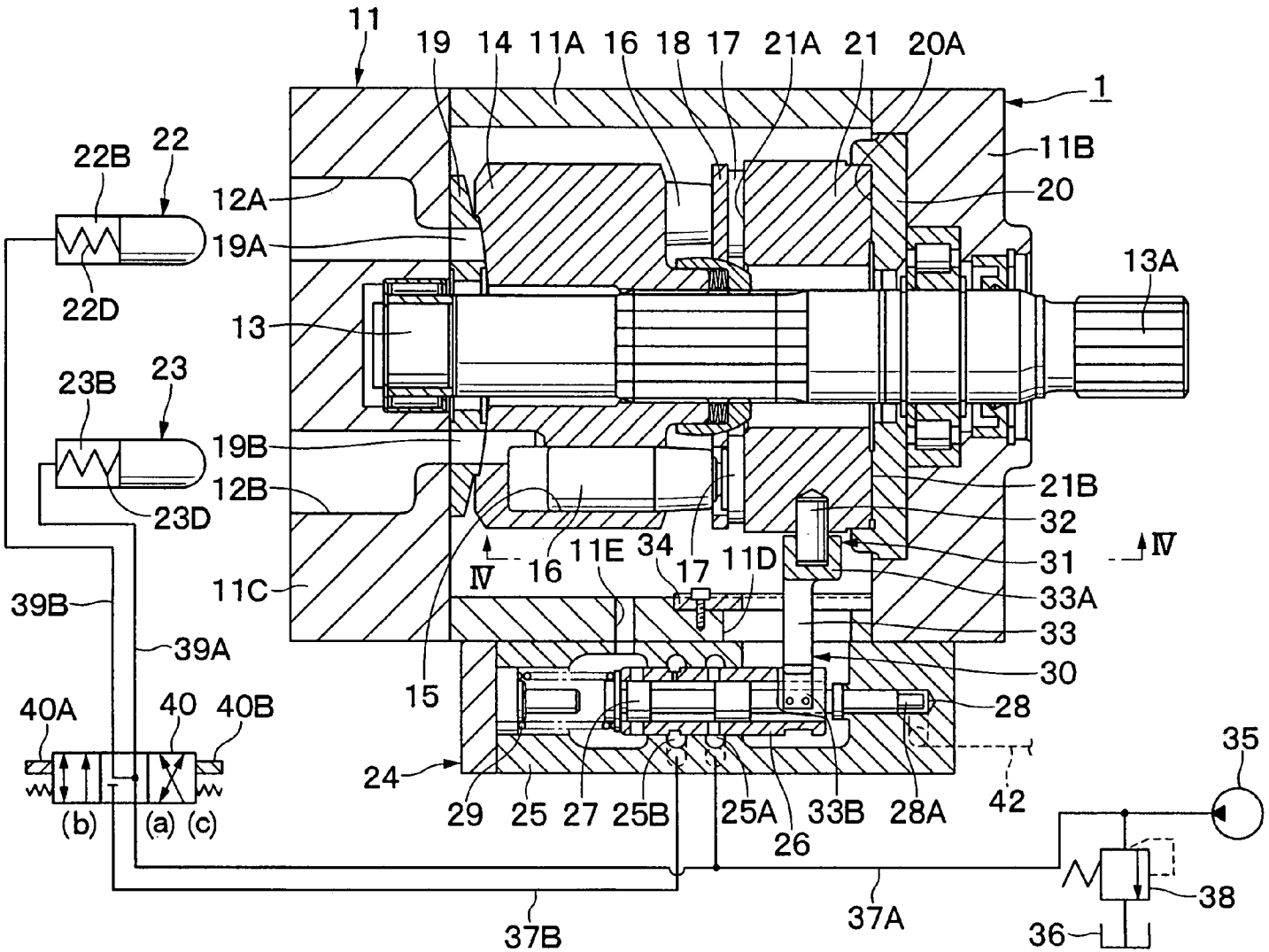
FIG. 3 is a vertical sectional view of the hydraulic pump, taken in the direction of arrows III—III in FIG. 2.

Denoted at 11 is a casing which forms an outer shell of the hydraulic pump 1. As shown in FIGS. 2 and 3, the casing 11 is composed of a tubular main casing 11A and front and rear casings 11B and 11C which close front and rear ends of the main casing 11A. Provided in the rear casing 11C are a pair of passages 12A and 12B which are connected to the main conduits 3A and 3B shown in FIG. 1.

Further, as shown in FIG. 3, provided in an outer peripheral side of the main casing 11A is an slot 11D and a drain passage 11E, which are connected into a valve housing 25 of a regulator 24 which will be described hereinafter. A translation bar 33 is slidably fitted in the slot 11D in the main casing 11A through a guide member 34, as described in greater detail hereinafter. The internal cavity of the casing 11 forms a drain chamber which is connected to a tank 36 which will be described hereinafter.

Indicated at 13 is a rotational shaft which is rotatably mounted in the casing 11. Namely, the rotational shaft 13 is rotatably supported in the front and rear casings 11B and 11C through bearings. At an end 13A which is axially projected out of the front casing 11B, the rotational shaft 13 is rotationally driven by the prime mover 2 which is shown in FIG. 1.

Designated at 14 is a cylinder block which is provided within the casing 11 and rotatable integrally with the rotational shaft 13. A plural number of axially extending cylinders 15 are provided within the cylinder block 14 at predetermined intervals in the circumferential direction.

Indicated at 16 are pistons which are slidably fitted in the cylinders 15 in the cylinder blocks 14. When a swash plate 21, which will be described hereinafter, is tilted in a forward or reverse direction, each one of the pistons 16 is reciprocated within a cylinder 15 in step with rotation of the cylinder block 14 to repeat intake and discharge cycles.

At one end, the pistons 16 are projected out of the cylinders 15 of the cylinder block 14 in the axial direction of the rotational shaft 13, and shoes 17 are rockably attached to the projected ends of the pistons 16.

Figure 4:
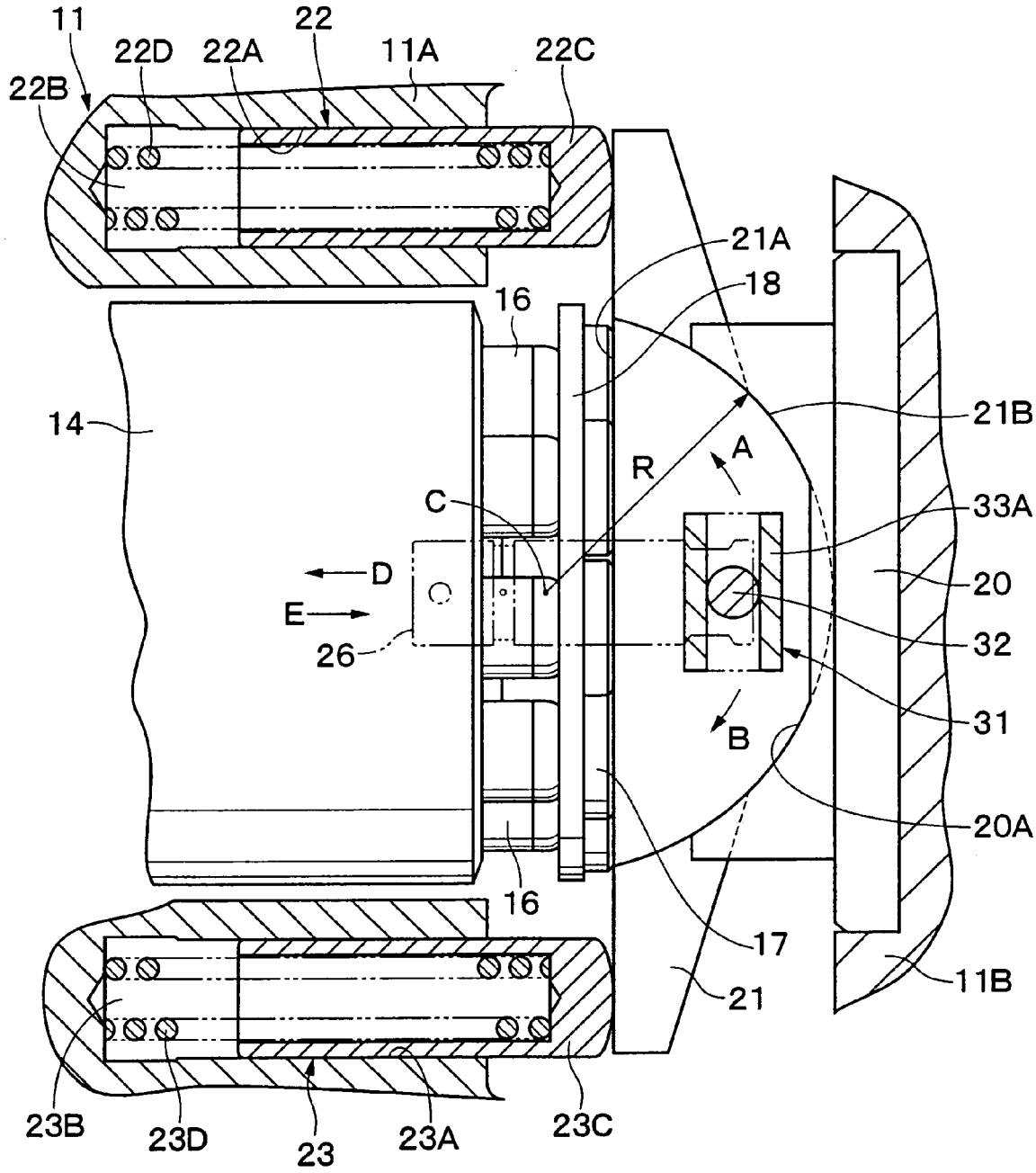
FIG. 4 is an enlarged sectional view taken in the direction of arrows IV—IV of FIG. 3, showing a swash plate in a neutral position.

Indicated at 18 is an annular shoe holder which is adapted to hold the respective shoes 17 against the swash plate 21. More particularly, as shown in FIGS. 3 and 4, the shoe holder 18 is adapted to hold the respective shoes 17 against a sliding surface 21A of the swash plate 21, guaranteeing for each one of the shoes 17 to be put in sliding movement on the sliding surface 21A of the swash plate 21, drawing an annular locus of movement.

Indicated at 19 is a valve plate which is provided in the casing 11, located between the rear casing 11C and the cylinder block 14. This valve plate 19 is held in sliding contact with an end face of the cylinder block 14, supporting the cylinder block 14 for rotation with the rotational shaft 13. As shown in FIG. 3, the valve plate 19 is provided with a pair of inlet/outlet ports 19A and 19B of an eyebrow shape. These inlet/outlet ports 19A and 19B are communicated with passages 12A and 12B in the rear casing 11C.

During rotation of the cylinder block 14, the inlet/outlet ports 19A and 19B of the valve plate 19 are intermittently communicated with the respective cylinders 15, sucking operating oil into the respective cylinders 15 through one of the passage 12A (or 12B) and delivering pressure oil to the other one of the passage 12B (or 12A) after pressurizing the operating oil by the pistons 16 in the respective cylinders 15.

Indicated at 20 is a swash plate support member which is provided in the front casing 11B and around the outer periphery of the rotational shaft 13. This swash plate support member 20 is located on the rear side of the swash plate 21, and provided with a tilting support surface 20A for tiltably supporting the swash plate 21. As shown in FIG. 4, the tilting support surface 20A is in the form of a concavely curved surface to guide sliding movements of the swash plate 21 in the directions of arrows A and B and around a tilting center C.

Denoted at 21 is a swash plate which is tiltably mounted in the casing 11 through the swash plate support member 20 to form a volume varying portion. The swash plate 21 is provided with a sliding surface 21A at the front side for the respective shoes 17 and a tilting guide surface 21B of a convexly curved shape at the rear side which is fitted in the tilting support surface 20A of the swash plate support member 20.

Figure 5:
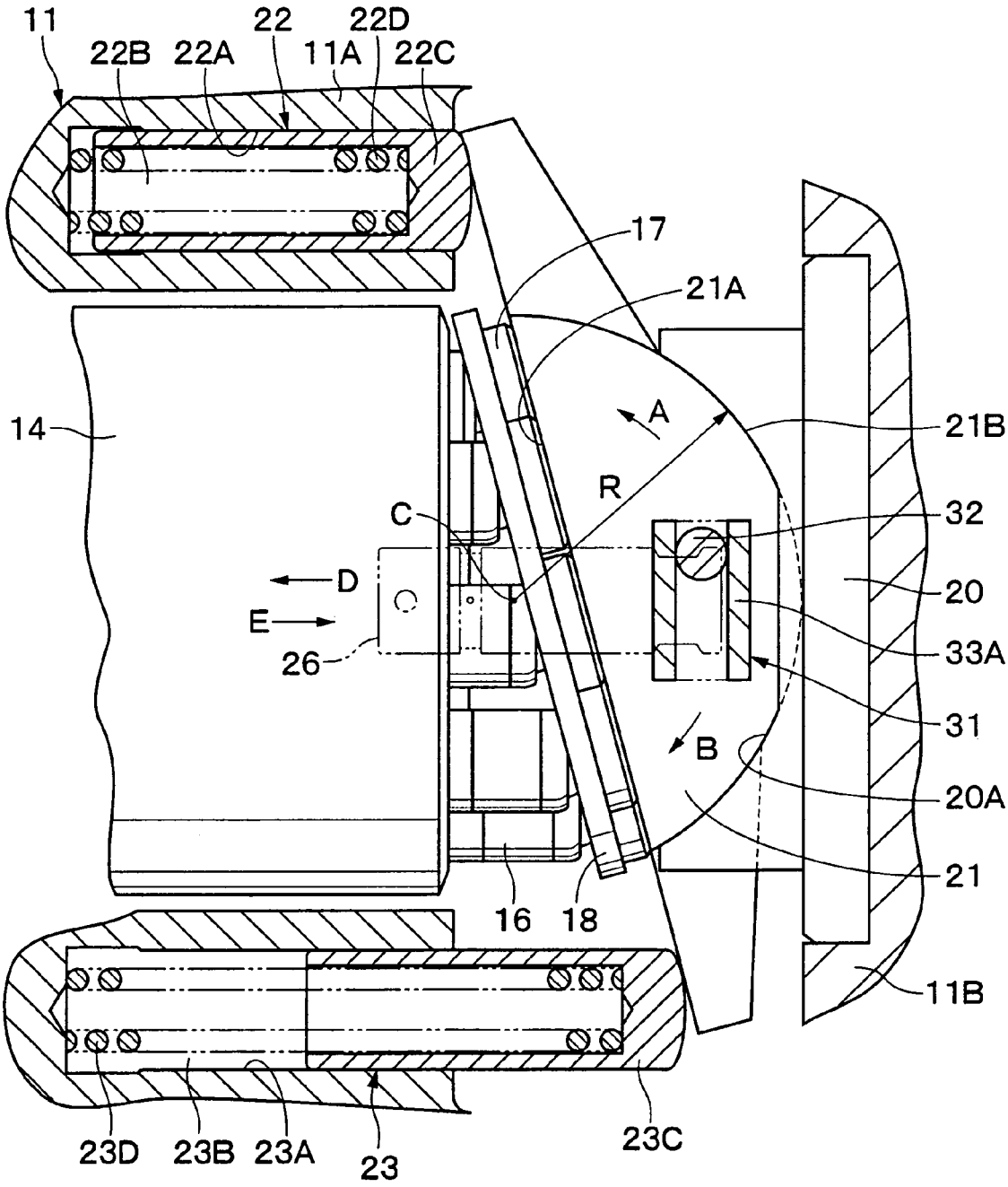
FIG. 5 is a sectional view taken from the same position as FIG. 4, showing the swash plate which has been tilted in a forward direction.
Figure 6:
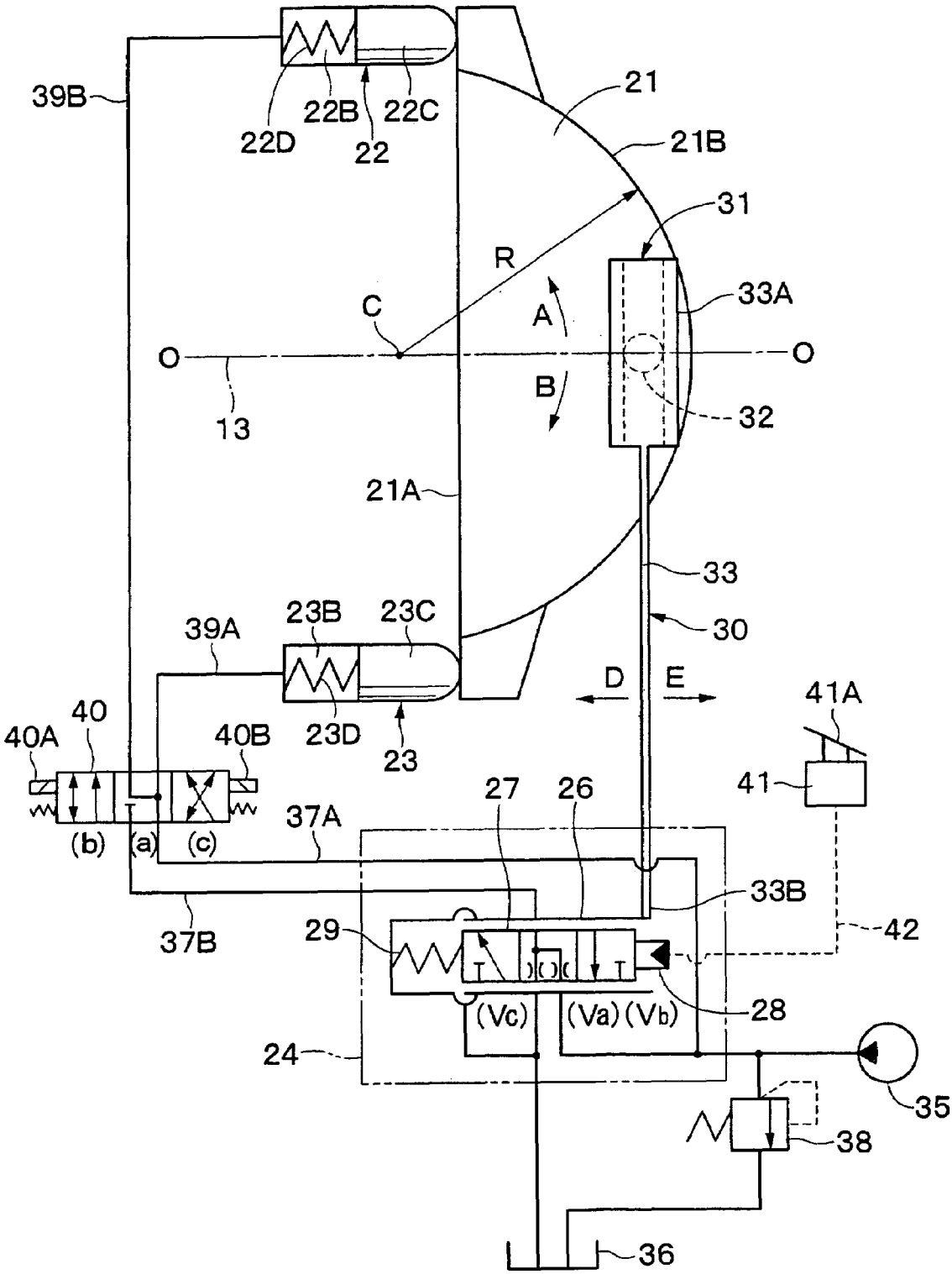
FIG. 6 is a circuit diagram of a tilting controller for the swash plate in the first embodiment.

In this instance, as shown in FIGS. 4 to 6, the tilting guide surface 21B of the swash plate 21 is formed as an arcuate surface of radius R from the tilting center C. The tilting center C is located on an axis line O—O which extends parallel with the rotational shaft 13. By the use of tilting actuators 22 and 23 which will be described hereinafter, the swash plate 21 is driven to tilt either in a forward direction (in the direction of arrow A) or in a reverse direction (in the direction of arrow B) from the neutral position or zero angle position shown in FIGS. 4 and 7. At this time, the capacity (oil discharge rate) of the hydraulic pump 1 is controlled by the tilting angle θ of the swash plate 21.

Indicated at 22 and 23 are a pair of tilting actuators for driving the swash plate 21 into a tilted position. As shown in FIGS. 2 to 5, these tilting actuators 22 and 23 are constituted by cylinder bores 22A and 23A which are formed in the main casing 11A on radially outer side of the cylinder block 14, tilting pistons 22C and 23C which are slidably fitted in the cylinder bores 22A and 23A to define pressure chambers 22B and 23B between the cylinder bores 22A and 23A, respectively, and bias springs 22D and 23D located in the pressure chambers 22B and 23B, respectively, for constantly urging the tilting pistons 22C and 23C toward the swash plate 21.

In this instance, the tilting actuators 22 and 23 are so located in the main casing 11A as to radially confront each other across the cylinder block 14, driving the swash plate 21 to tilt in the direction of arrow A or B by the tilting piston 22C or 23C. Namely, as shown in FIGS. 3 and 6, the pressure chambers 22B and 23B of the tilting actuators 22 and 23 are connected to the control conduits 39B and 39A, which will be described hereinafter, to receive or discharge tilting control pressure therethrough.

When the tilting piston 23C is extended out of the cylinder bore 23A by the tilting control pressure and the tilting piston 22C is contracted into the cylinder bore 22A as shown in FIG. 5, the swash plate 21 is driven by the tilting piston 23C to tilt in the direction of arrow A (in a forward direction). On the other hand, when the tilting piston 22C is extended out of the cylinder bore 22A and the tilting piston 23C is contracted into the cylinder bore 23A, the swash plate 21 is driven by the tilting piston 22C to tilt in the direction of arrow B (in a reverse direction).

Indicated at 24 is a regulator which functions as a volume control valve for supplying tilting control pressure to and from the tilting actuators 22 and 23. As shown in FIG. 3, the regulator 24 is constituted by a valve housing 25 which is provided on the casing 11 on the outer side of the main casing 11A, a control sleeve 26, spool 27, hydraulic pilot portion 28 and valve spring 29, which will be described hereinafter. Namely, as shown in FIG. 6, the regulator 24 is constituted by a hydraulic servo valve having a spool 27 within a control sleeve 26 for the control of tilting.

In this instance, as shown in FIG. 3, tilting control pressure inlet/outlet ports 25A and 25B are provided in the valve housing 25 of the regulator 24. The input/output port 25A is connected to a delivery side of a pilot pump 35 through a control conduit 37A which will be described hereinafter. The other input/output port 25B is connected to a control conduit 37B which will also be described hereinafter. The valve housing 25 of the regulator 24 is fixed liquid tight on the outer side of the casing 11, and the control sleeve 26 and spool 27 are disposed parallel with the rotational shaft 13 (parallel with the axis line O—O shown in FIG. 6).

Indicated at 26 is a tubular control sleeve which is slidably fitted in the valve housing 25. At one end of axial direction of the control sleeve 26, a translation bar 33, which will be described hereinafter, is integrally connected to the outer periphery of the control sleeve by means of a plural number of set screws, so that the control sleeve 26 is put in sliding displacements within the valve housing 25 in axial directions (in the directions of arrows D and E in FIG. 4) following the movements of the translation bar 33 (rectilinear movements along the axial direction of the rotational shaft 13).

Indicated at 27 is a spool which is slidably fitted in the control sleeve 26. As the control spool 27 is put in sliding movement on the inner peripheral side of the control sleeve 26 in the axial direction of the valve housing 25, the input/output port 25B is selectively brought into or out of communication with the input/output port 25A or a drain passage 11E.

Denoted at 28 is a hydraulic pilot portion which is provided in the valve housing 25 in association with one end of axial direction of the spool 27. This hydraulic pilot portion 28 is provided with a plunger 28A for axially driving the spool 27 against a valve spring 29 which will be described hereinafter, and supplied with a command pressure through a command pressure conduit 42 which will also be described hereinafter.

Upon receiving a command pressure as a pilot pressure through the command pressure conduit 42, the plunger 28A of the hydraulic pilot portion 28 puts the spool 27 in an axial sliding movement in the valve housing 25 according to the pilot pressure thereby switching the regulator 24 from a neutral position (Va) to a switched position (Vb) or (Vc) shown in FIG. 6.

Indicated at 29 is a valve spring which is interposed between the other end of axial direction of the spool 27 and the valve housing 25. By the action of this valve spring 29, the spool 27 is constantly urged toward the hydraulic pilot portion 28, for example, to return the regulator 24 to the neutral position (Va) shown in FIG. 6.

Indicated at 30 is a feedback mechanism adopted in the first embodiment of the invention. This feedback mechanism 30 is provided for feedback control of the regulator 24 by letting same follow tilting motions of the swash plate 21. In this instance, as shown in FIGS. 3 and 6, the feedback mechanism 30 is constituted by a motion converting section 31 and the translation bar 33, which are provided between a lateral side of the swash plate 21 and the control sleeve 26 of the regulator 24 as described in greater detail hereinafter.

As the swash plate 21 is tilted from the neutral position in a forward or reverse direction, the feedback mechanism 30 put the translation bar 33 in a rectilinear movement along the axis line O—O of the rotational shaft 13, which is a straight line passing through the tilting center C of the swash plate 21.

Indicated at 31 is a motion converting section of the feedback mechanism 30, functioning to convert a tilting motion of the swash plate 21 into an axial displacement along the axis line O—O of the rotational shaft 13. In this instance, the motion converting section 31 is constituted by a projection 32 as an active coupling member which is fixed on and projected from an outer peripheral side of the swash plate 21, and a slider portion 33A as a passive coupling member which is provided on the translation bar 33 as described below.

The slider portion 33A of the translation bar 33 is slidably engaged with the projection 32 on the side of the swash plate 21 to convert a tilting motion of the swash plate 21 into an axial displacement as a longitudinal linear displacement along the axis line O—O. As shown in FIGS. 3 to 9, the projection 32 on the side of the swash plate 21 and the slider portion 33A of the translation bar 33 are relatively slidably engaged with each other.

Namely, the projection 32 and the slider portion 33A restrict movements of the translation bar 33 relative to the swash plate 21 (relative to the projection 32) in the direction of the axis line O—O of the rotational shaft 13, while permitting relative movements of the swash plate 21 (the projection 32) and the translation bar 33 in a direction perpendicular to the axis line O—O of the rotational shaft 13.

Figure 7:
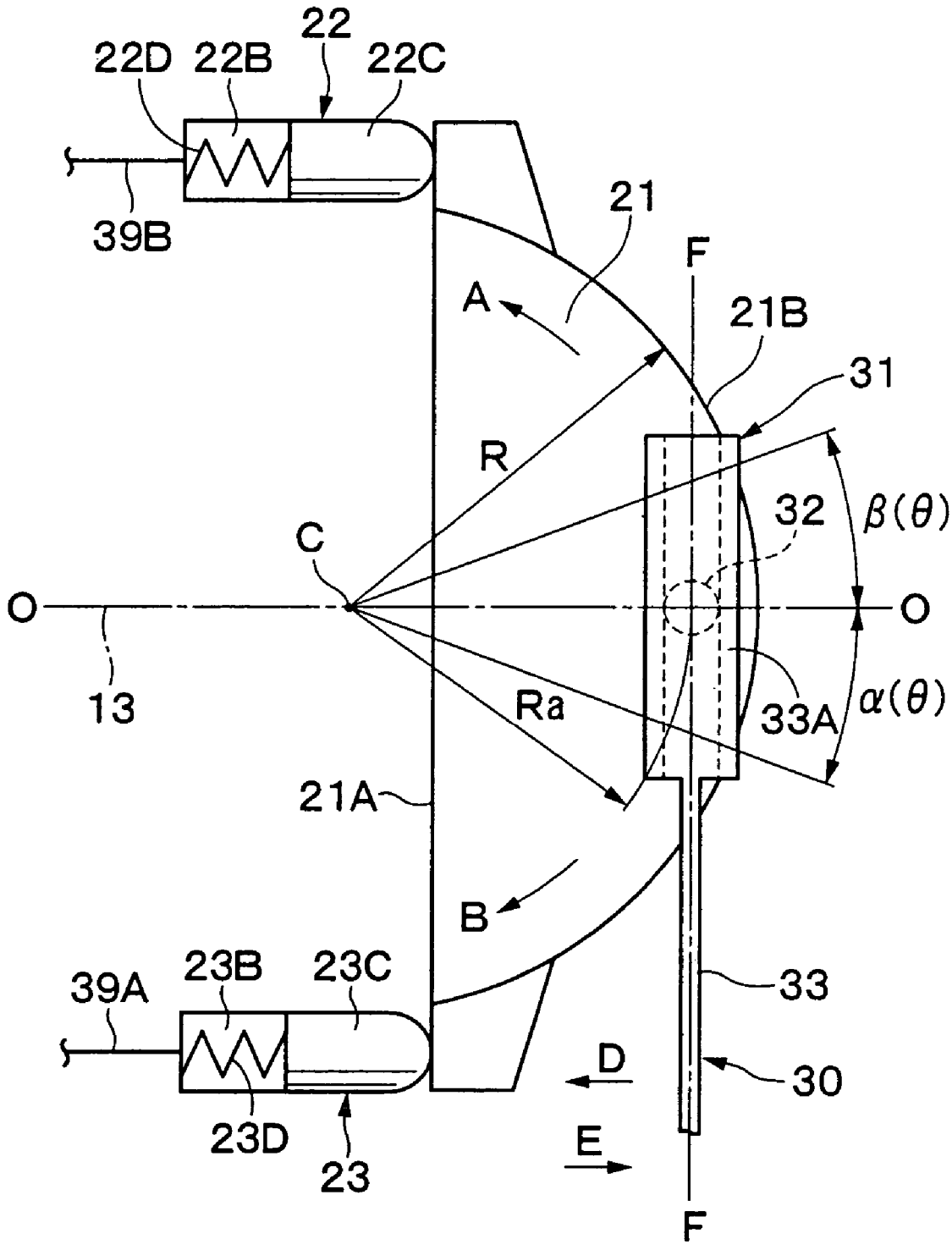
FIG. 7 is a front view showing the swash plate and feedback mechanism of FIG. 6 along with the tilting pistons.

In this instance, the projection 32 is formed in a round columnar shape by the use of a bolt or pin which is fixedly planted on a lateral side of the swash plate 21. When the swash plate 21 is located in the neutral position of zero angle as shown in FIGS. 6 and 7, the projection 32 is located in a perpendicularly intersecting position relative to the axis line O—O of the rotational shaft 13. Further, as shown in FIG. 7, the projection 32 is located in a position at a radius Ra from the tilting center C of the swash plate 21, the radius Ra being smaller than the radius R of the tilting guide surface 21B (Ra<R).

Indicated at 33 is the translation bar as a translation member which constitutes a displacement transmission member of the feedback mechanism 30. As shown in FIG. 3, this translation bar 33 is slidably mounted in the slot 11D in the main casing 11A through a guide member 34, which will be described hereinafter, for rectilinear movement along the axial direction of the rotational shaft 13 (the axis line O—O shown in FIG. 6). As shown in FIG. 3, the translation bar 33 is extended in the casing 11 and through the radial direction of the rotational shaft 13 and located between outer peripheral side of the swash plate 21 and the control sleeve 26.

In the particular embodiment shown, the translation bar 33 is provided with a U-shaped slider portion 33A at one longitudinal end, which slider portion 33A constitutes the motion converting section 31 in the feedback mechanism together with the projection 32 on the side of the swash plate 21. As shown in FIGS. 6 to 9, the slider portion 33A is extended in a direction perpendicular to the axis line O—O of the rotational shaft 13, and the projection 32 on the side of the swash plate 21 is slidably engaged in the slider portion 33A.

When the swash plate 21 is in the neutral position, the slider portion 33A of the translation bar 33 is located in an initial position of FIG. 7 on a line F—F perpendicular to the axis line O—O of the rotational shaft 13, together with the projection 32 of the swash plate 21. At this time, the translation bar 33 is located in a fully receded position along the axis line O—O of the rotational shaft 13 in the direction of arrow E in FIG. 6.

Figure 8:
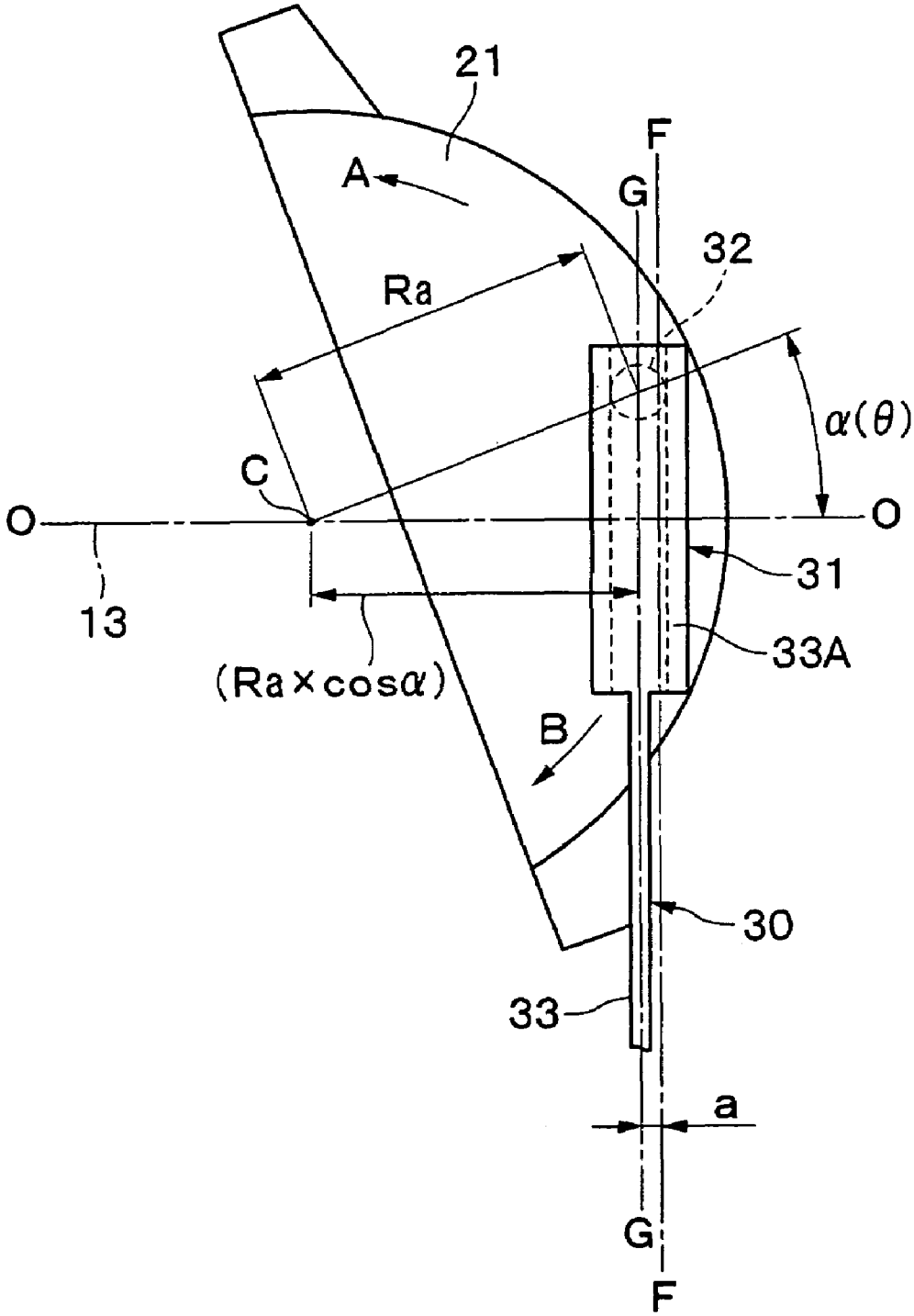
FIG. 8 is a front view showing the swash plate of FIG. 7 which has been tilted in a forward direction.

When the swash plate 21 is tilted from the neutral position in the direction of arrow A (in a forward direction) until the tilt angle $\theta$ reaches an angle $\alpha$ ($\theta=\alpha$) as shown in FIGS. 5 and 8, the projection 32 on the swash plate 21 is turned to a position of angle $\alpha$ relative to the axis line O—O. As a consequence, following the movement of the projection 32, the slider portion 33A of the translation bar 33 is translated to a position on line G—G in FIG. 8 (rectilinear movement), that is, displaced from the line F—F of the initial position by a distance a in the axial direction of the rotational shaft 13.

Figure 9:
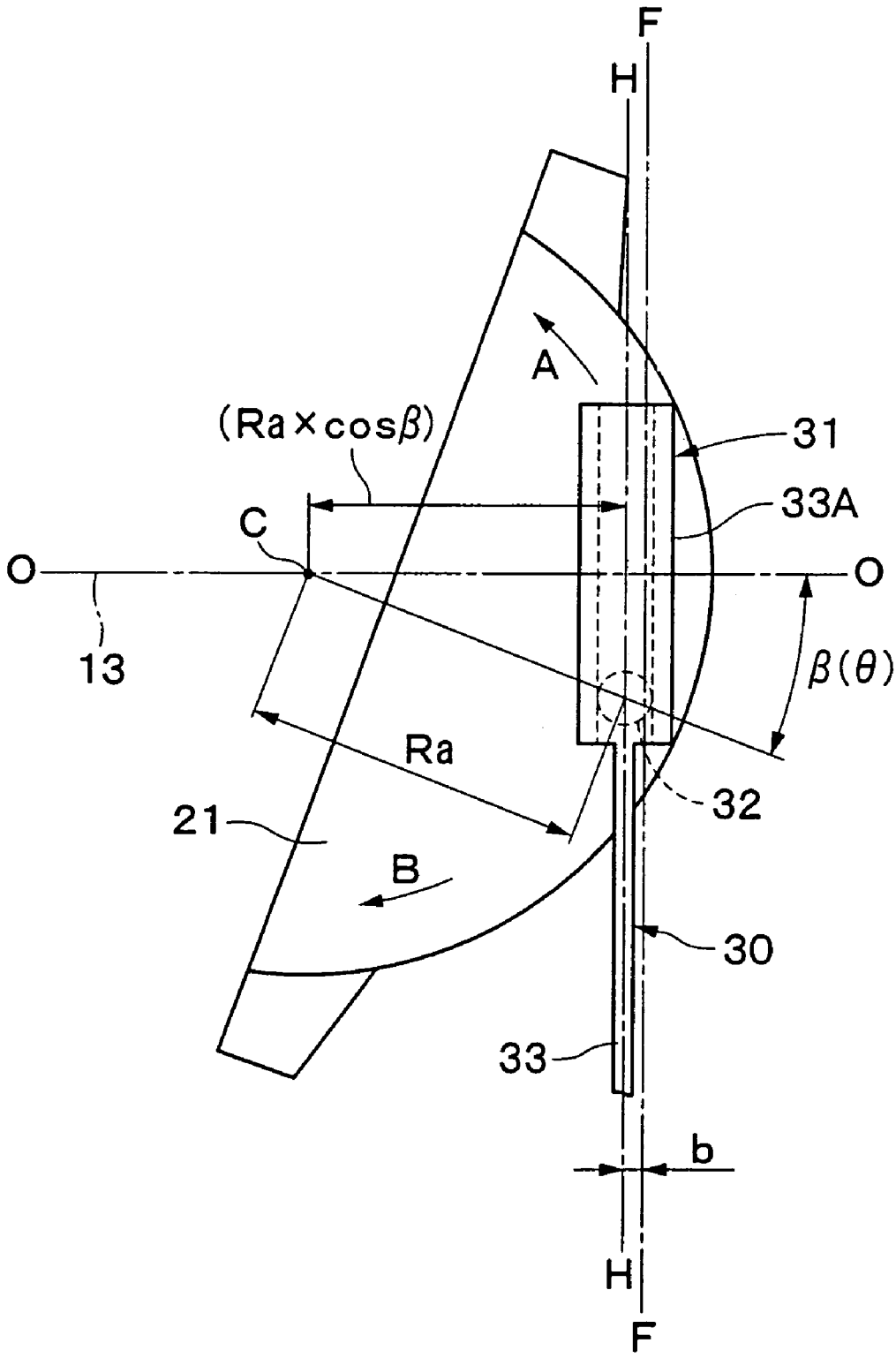
FIG. 9 is a front view showing the swash plate of FIG. 7 which has been tilted in a reverse direction.

On the other hand, when the swash plate 21 is tilted from the neutral position in the direction of arrow B (in a reverse direction) until the tilt angle $\theta$ reaches an angle $\beta$ ($\theta=\beta$) as shown in FIG. 9, the projection 32 on the swash plate 21 is turned to a position of the angle $\beta$ relative to the axis line O—O. As a consequence, the slider portion 33A of the translation bar 33 is translated to a position on line H—H of FIG. 9 following the movement of the projection 32, that is to say, displaced from the initial position on line F—F by a distance b in the axial direction of the rotational shaft 13.

When the swash plate 21 is tilted in the forward or reverse direction through the same tilt angle $\theta$ (e.g., through the angle $\alpha$ or $\beta$, these tilting angles $\alpha$ and $\beta$ corresponding to the tilt angle $\theta$ of the swash plate 21 are equivalent angles in opposite directions ($\alpha=\beta$) and bring about the equivalent distances a and b corresponding to an axial displacement.

As shown in FIG. 3, the other longitudinal end of the translation bar 33 is extended in the radial direction of the control sleeve 26, and provided with a bifurcated anchor portion 33B at a distal end which is adapted to embrace the control sleeve 26 from radially outside. The anchor portion 33B is securely fixed to the outer periphery of the control sleeve 26 by a plural number of set screws or rivets.

Thus, the translation bar 33 is fixedly retained on the control sleeve 26 at a predetermined angle relative to the latter (e.g., at an angle of 90 degrees). As shown in FIGS. 4 to 6, following movements of the translation bar 33, the control sleeve 26 is displaced in the directions of arrows D and E along the axis line O—O of the rotational shaft 13.

In this manner, as the swash plate 21 is tilted in a forward or reverse direction together with the projection 32, the tilting motion of the swash plate 21 is picked up as an axial displacement of the slider portion 33A in the direction of axis line O—O of the rotational shaft 13 (e.g., the distance a or b) by the motion converting section 31 having the projection 32 on the side of the swash plate 21 engaged with the slider portion 33A of the translation bar 33. The translation bar 33, which functions as a displacement transmission member, transmits an axial displacement of the slider portion 33A to the control sleeve 26 through the anchor portion 33B as a similar axial displacement.

Indicated at 34 is a guide member which is provided in such a manner as to cover the slot 11D in the casing 11. As shown in FIG. 3, the guide member 34 is arranged to slidably support an longitudinally intermediate portion of the translation bar 33, preventing upward or downward rocking movements (e.g., rocking movements in the circumferential direction of the cylinder block 14) or rattling movements of the translation bar 33 to ensure smooth parallel movement (rectilinear movement) of the latter in the axial direction of the rotational shaft 13.

Thus, as the swash plate 21 is tilted in the direction of arrow A or B in FIG. 2, the translation bar 33 of FIG. 3 is put in a parallel movement in the axial direction of the rotational shaft 13, following the tilting motion of the swash plate 21. The parallel movement of the translation bar 33 is directly transmitted to the control sleeve 26 of the regulator 24 by the anchor portion 33B, for feedback control of the regulator 24.

Indicated at 35 is a pilot pump for generating a tilting control pressure. This pilot pump 35 rotationally driven from the prime mover 2 of FIG. 1 together with the hydraulic pump 1. While pumping in operating oil, for example, from the tank 36 shown in FIG. 3, the pilot pump 35 delivers a tilting control pressure to the control conduit 37A.

In this instance, by a low pressure relief valve 38, the tilting control pressure which is delivered by the pilot pump 35 is maintained at a sufficiently low level as compared with the output pressure of the hydraulic pump 1. The control conduit 37B is provided between the inlet/outlet port 25B of the regulator 24 and a forward/reverse directional control valve 40 which will be described hereinafter.

Designated at 39A and 39B are other control conduits which supply a tilting control pressure to and from pressure chambers 23B and 22B of the tilting actuators 23 and 22. As shown in FIGS. 3 and 6, the control conduits 39A and 39B are switched over between the control conduits 37A and 37B by the forward/reverse directional control valve 40 as described below.

Indicated at 40 is a forward/reverse directional control valve as a directional control valve which is connected between the control conduits 37A and 37B and the control conduits 39A and 39B. As shown in FIGS. 3 and 6, this forward/reverse directional control valve 40 is provided with left and right solenoids 40A and 40B. For example, by manually operating a switch lever (not shown) which is provided in an operator's room of the vehicle, this forward/reverse directional control valve 40 can be switched from a stop position (a) to a forward drive position (b) or a reverse drive position (c).

When the forward/reverse directional control valve 40 switched from the stop position (a) to the forward drive position (b), tilting control pressure from the pilot pump 35 is supplied to the pressure chamber 23B of the tilting actuator 23 through the control conduits 37A and 39A, according to the extent of depression of a vehicle drive pedal 41A by an operator's foot.

Further, at this time, tilting control pressure in the pressure chamber 22B of the tilting actuator 22 is discharged to the side of the tank 36 through the control conduits 39B and 37B and the regulator 24. As a result, the swash plate 21 is driven to tilt in the direction of arrow A in FIG. 6 by the tilting piston 23C of the tilting actuator 23.

On the other hand, when the forward/reverse directional control valve 40 is switched to the reverse drive position (c) from the stop position (a), tilting control pressure from the pilot pump 35 is supplied to the pressure chamber 22B of the tilting actuator 22 through the control conduits 37A and 39B, according to the extent of depression of a vehicle drive pedal 41A. Further, tilting control pressure in the pressure chamber 23B of the tilting actuator 23 is discharged to the side of the tank 36 through the control conduits 39A and 37B and the regulator 24. As a result, the swash plate 21 is driven to tilt in the direction of arrow B in FIG. 6 by the tilting piston 22C of the tilting actuator 22.

In this manner, the forward/reverse directional control valve 40 is provided between the regulator 24 and the tilting actuators 22 and 23 to switch the vehicle drive position from the stop position (a) to the forward drive position (b) or reverse drive position (c). For changing the vehicle drive position, the forward/reverse directional control valve 40 switches the direction of the tilting control pressure supply to and from the tilting actuators 22 and 23, while driving the swash plate 21 in the neutral position to tilt in the forward or reverse direction, following the tilting control pressure.

Indicated at 41 is a vehicle operating valve which is provided as a command means within an operating room of the wheel type vehicle. As shown in FIG. 6, a vehicle drive pedal 41A corresponding to an accelerator pedal is attached to the vehicle operating valve 41. When the vehicle drive pedal 41A is pressed by an operator's foot, a pilot pressure is supplied as a command signal to the hydraulic pilot portion 28 of the regulator 24 from the vehicle operating valve 41 via the command pressure conduit 42 for variably adjusting the traveling speed of the vehicle in the manner as described hereinafter.

According to the present embodiment, the vehicle drive hydraulic circuit for a wheel type working vehicle with a swash plate type variable displacement hydraulic pump is arranged as described above, and put in operation in the manner as follows.

In operation, when the forward/reverse directional control valve 40 of FIG. 6 is in the stop position (a), both of the control conduits 39A and 39B are connected to the control conduit 37A. At this time, the pressure chambers 22B and 23B of the tilting actuators 22 and 23 are maintained at the same pressure level, and the swash plate 21 is retained in the neutral position of zero angle.

Therefore, even if the prime mover 2 is started to rotationally drive the rotational shaft 13, putting the cylinder block 14 in rotation with the rotational shaft, the pistons 16 are not reciprocated in the respective cylinders 15 of the cylinder block 14, and pressures in the passages 12A and 12B in the hydraulic pump 1 remain at the same level. Accordingly, the hydraulic motor 5 of FIG. 1 remains at rest because no oil pressure is supplied thereto from the hydraulic pump 1 through the main conduits 3A and 3B.

In the next place, as soon as the forward/reverse directional control valve 40 in the stop position (a) is switched to the forward drive position (b) by the operator, the tilting control pressure from the pilot pump 35 is supplied to the pressure chamber 23B of the tilting actuator 23 through the control conduits 37A and 39A, according to the degree of depression of the vehicle drive pedal 41A by an operator's foot.

Thus, at this time, as the vehicle drive pedal 41A is pressed by an operator's foot, a pilot pressure is supplied toward the hydraulic pilot portion 28 of the regulator 24 from a command pressure conduit 42. Whereupon, the spool 27 in the valve housing 25 of the regulator 24 makes a sliding displacement in the axial direction according to the pilot pressure to switch the regulator 24 to a switched position (Vb) from a neutral position (Va) shown in FIG. 6.

As a result, the control conduit 37B is connected to the tank 36 through the regulator 24 and the drain chamber within the casing 11, and tilting control pressure is discharged from the pressure chamber 22B of the tilting actuator 22 toward the tank 36 through the control conduit 39B, the forward/reverse directional control valve 40 in the forward drive position (b), the control conduit 37B and the regulator 24.

At this time, the tilting control pressure from the pilot pump 35 is supplied to the pressure chamber 23B of the tilting actuator 23 through the control conduit 37A, the forward/reverse directional control valve 40 in the forward drive position (b) and the control conduit 39A. By the tilting piston 23C of the tilting actuator 23, the swash plate 21 is driven to tilt in the direction of arrow A in FIG. 6.

When the swash plate 21 is tilted in the direction of arrow A, by rotation of the cylinder block 14 with the rotational shaft 13, the respective pistons 16 are repeatedly reciprocated within the cylinders 15 of the cylinder block 14 at a stroke volume (displacement volume) corresponding to the tilt angle θ. At this time, the hydraulic pump 1 draws oil into the respective cylinders 15, for example, through the passage 12A, while discharging oil from the passage 12B.

As a result, in the vehicle drive closed hydraulic circuit 4 of FIG. 1, pressure oil is circulated in the main conduits 3A and 3B in the direction of arrow A1, rotationally driving the hydraulic motor 5 with pressure oil. Rotational output of the hydraulic motor 5 is transmitted to wheels 7 of the wheel type working vehicle through the reducer 6. By driving the wheels 7, the working vehicle is put in travel, for example, in a forward direction at a speed corresponding to the tilt angle θ.

On the other hand, when the forward/reverse directional control valve 40 from the stop position (a) is switched to the reverse drive position (c), a tilting control pressure is supplied from the pilot pump 35 to the pressure chamber 22B of the tilting actuator 22 through the control conduits 37A and 39B, according to the extent of depression of the vehicle drive pedal 41A. Further, tilting control pressure is discharged from the pressure chamber 23B of the tilting actuator 23 to the tank 36 through the control conduits 39A and 37B and the regulator 24. As a result, by the tilting piston 22C of the tilting actuator 22, the swash plate 21 is driven to tilt in the direction of arrow B in FIG. 6.

In this case, in the vehicle drive closed hydraulic circuit 4 shown in FIG. 1, pressure oil is circulated in the direction of arrow B1 for rotationally driving the hydraulic motor 5 in the same direction. Consequently, by transmitting the rotational output of the hydraulic motor 5 to wheels 7 of the wheel type working vehicle through the reducer 6, the vehicle can be driven in the reverse direction at a speed corresponding to the tilt angle θ.

When the vehicle is put in travel in forward or reverse direction, the vehicle speed is determined by the discharge rate (flow rate) of pressure oil by the hydraulic pump 1, and the discharge rate is increased or decreased depending upon the tilt angle θ of the swash plate 21. Unless the regulator 24, which is a volume control valve, is operated under a feedback control according to the tilt angle θ of the swash plate 21, it is difficult to stably control the tilt angle θ of the swash plate (or the vehicle speed) solely by way of depressing operations on the vehicle drive pedal 41A.

Therefore, according to the present embodiment, the feedback mechanism 30 is provided between the control sleeve 26 of the regulator 24 and a lateral side of the swash plate 21. As a result of feedback control by this feedback mechanism 30, the regulator 24 is made to follow tilting motions of the swash plate 21 whenever the latter is driven to tilt from a neutral position of the zero angle to the forward or reverse direction by the tilting actuator 23 or 22.

The feedback mechanism 30 is constituted by the motion converting section 31 which translate a tilting motion of the swash plate 21 into an axial displacement, and the translation bar 33 which is moved in the axial direction of the rotational shaft 13, following tilting motions of the swash plate which are converted into axial displacements by the motion converting section 31. An axial displacement, converted by the motion converting section 31, transmitted to the control sleeve 26 of the regulator 24 through the anchor portion 33B at the distal end of the translation bar 33.

In this instance, the motion converting section 31 is constituted by the pin or round projection 32 which is fixed on a lateral side of the swash plate 21, and the U-shaped slider portion 33A which is provided at one longitudinal end of the translation bar 33 in a direction perpendicular to the axis line O—O of the rotational shaft 13 and slidably coupled with the projection 32. By the motion converting section 31, a tilting motion of the swash plate 21 is transmitted to the translation bar 33 as an axial displacement in the direction of the axis line O—O.

Therefore, when the swash plate 21 in the neutral position is tilted in the direction of arrow A (in the forward direction) to a position where the tilt angle θ is an angle α (θ=α) as shown in FIG. 8, the projection 32 on the swash plate 21 is turned to a position of the angle α relative to the axis line O—O, putting the slider portion 33A of the translation bar 33 in a parallel movement as far as a position of line G—G of FIG. 8 following the movement of the projection 32.

When the projection 32, which is located at a radius Ra from the tilting center C of the swash plate 21, is turned through an angle α, the translation bar 33 is displaced in the axial direction of the rotational shaft 13 from an initial position on line F—F to a position on line G—G. This axial displacement can be obtained as a distance a by Equation (1) below.

$$a=Ra\times(1-\cos\alpha) \quad (1)$$

On the other hand, when the swash plate 21 in the neutral position is tilted in the direction of arrow B (in the reverse direction) to a position where the tilt angle θ is an angle β (θ=β) as shown in FIG. 9, the projection 32 on the swash plate 21 is turned to a position of the angle β relative to the axis line O—O, putting the slider portion 33A of the translation bar 33 in a parallel movement as far as a position on line H—H of FIG. 9 following the movement of the projection 32.

When the translation bar 33 in the initial position on line F—F is displaced to the position on line H—H in the axial direction of the rotational shaft 13, this axial displacement can be obtained as a distance b by Equation (2) below.

$$b=Ra\times(1-\cos\beta) \quad (2)$$

In this manner, by the motion converting section 31, that is, by the projection 32 on the swash plate 21 and the slider portion 33A of the translation bar 33, a tilting motion of the swash plate 21 is converted into an axial displacement (e.g., of distance a or b) in the direction of axis line O—O of the rotational shaft 13, and this axial displacement is transmitted from the translation bar 33 to the control sleeve 26 through the anchor portion 33B.

Irrespective of the direction of a tilting motion of the swash plate 21, which is either in the direction of arrow A (forward direction) or in the direction of arrow B (reverse direction), the tilting motion is converted into an axial displacement of the same direction (in the direction of arrow D in FIG. 6). Namely, no matter whether the swash plate 21 is tilted in the forward or reverse direction from the neutral position, the control sleeve 26 of the regulator 24 is put in a sliding displacement in the same direction as the spool 27, permitting to realize smooth feedback control of the control sleeve 26.

Therefore, according to the present embodiment, even in a case where the swash plate type variable displacement hydraulic pump 1 is connected to the hydraulic motor 5 by the use of the closed hydraulic circuit 4 shown in FIG. 1, the discharge rate (flow rate) of the pressure oil can be controlled in both directions by tilting the swash plate 21 which serves as a volume varying portion in forward and reverse directions from the neutral position, permitting to control the vehicle speed according to the tilt angle of the swash plate 21 smoothly in both forward and reverse drives of the vehicle.

Besides, the regulator 24 which serves as a volume control valve can be constituted by a hydraulic servo valve of simple construction having the spool 27 within the control sleeve 26. Accordingly, it becomes possible to simplify the construction of the tilting controller as a whole, including the tilting actuators 22 and 23, regulator 24 and feedback mechanism 30, and to improve the efficiency of assembling work by reduction of assembling parts.

Further, the forward/reverse directional control valve 40 is provided between the regulator 24 and the tilting actuators 22 and 23. This arrangement makes it possible to simplify the construction of the tilting controller as a whole as compared with the prior art, including the regulator 24, and to improve productivity and cut production cost of the controller.

Furthermore, in addition to the closed hydraulic circuit 4 shown in FIG. 1, the tilting controller of the hydraulic pump 1 can be applied to supply pressure oil to a so-called open hydraulic circuit, supplying pressure oil to and from a hydraulic actuator like a hydraulic motor. Thus, thanks to improved versatility, the tilting controller of the hydraulic pump 1 can be applied to both a closed hydraulic circuit and an open hydraulic circuit, and can enhance productivity.

Turning now to FIGS. 10 through 16, there is shown a second embodiment of the present invention. A feature of this embodiment resides in that a feedback mechanism is constituted by a tilting lever which is provided on a lateral side of a swash plate for tilting motion therewith, and a translation member which is provided between the tilting lever and a control sleeve of a regulator. In the following description of the second embodiment, those component parts which are identical with the counterparts in the foregoing first embodiment are simply designated by the same reference numerals or characters to avoid repetitions of same explanations.

In the drawings, indicated at 51 is a swash plate type variable displacement hydraulic pump which is adopted by the present embodiment, and at 52 is a casing of the hydraulic pump 51. The casing 52 is built substantially in the same way as the casing 11 in the foregoing first embodiment. Namely, the casing 52 is composed of a main casing 52A, a front casing 52B, a rear casing 52C, a slot 52D and a drain passage 52E.

However, in this case, the casing 52 has the slot 52D and drain passage 52E in different positions. A translation bar 63 is slidably fitted in the slot 52D through a guide member 64, as described in greater detail hereinafter. The internal cavity of the casing 52 forms a drain chamber which is connected to the tank 36.

Indicated at 53 is a regulator which serves as a volume control valve for supplying tilting control pressure to and from the tilting actuators 22 and 23. This regulator 53 is built substantially in the same way as the regulator 24 in the foregoing first embodiment. More specifically, as shown in FIG. 10, the regulator 53 is constructed of a valve housing 54 which is provided on and attached to the outer side of the main casing 52A of the casing 52, a control sleeve 55 which is provided in the valve housing 54, a spool 56, a hydraulic pilot portion 57 and a valve spring 58.

Figure 10:
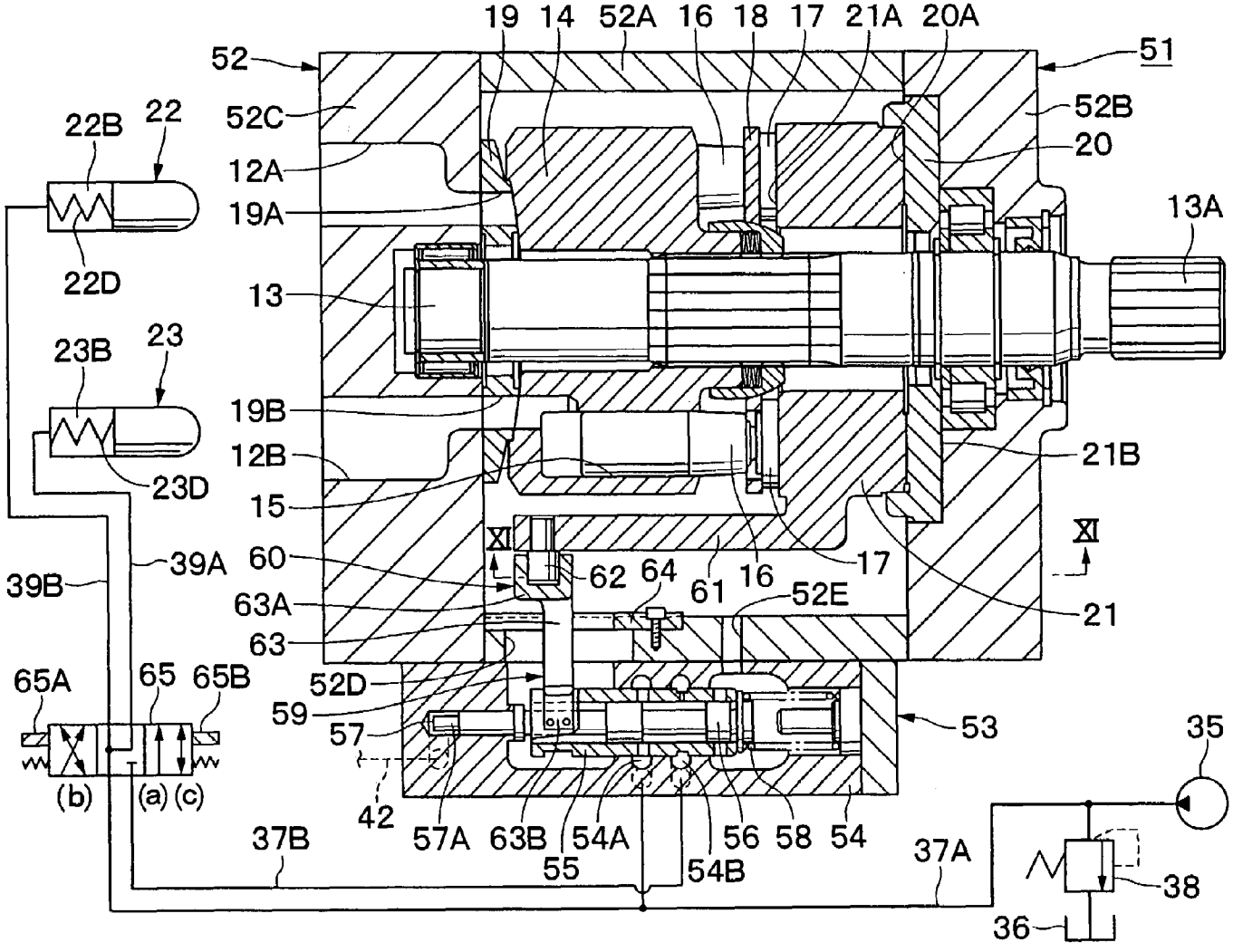
FIG. 10 is a vertical sectional view taken in the same position as FIG. 3, showing a hydraulic pump according to a second embodiment of the invention.
Figure 11:
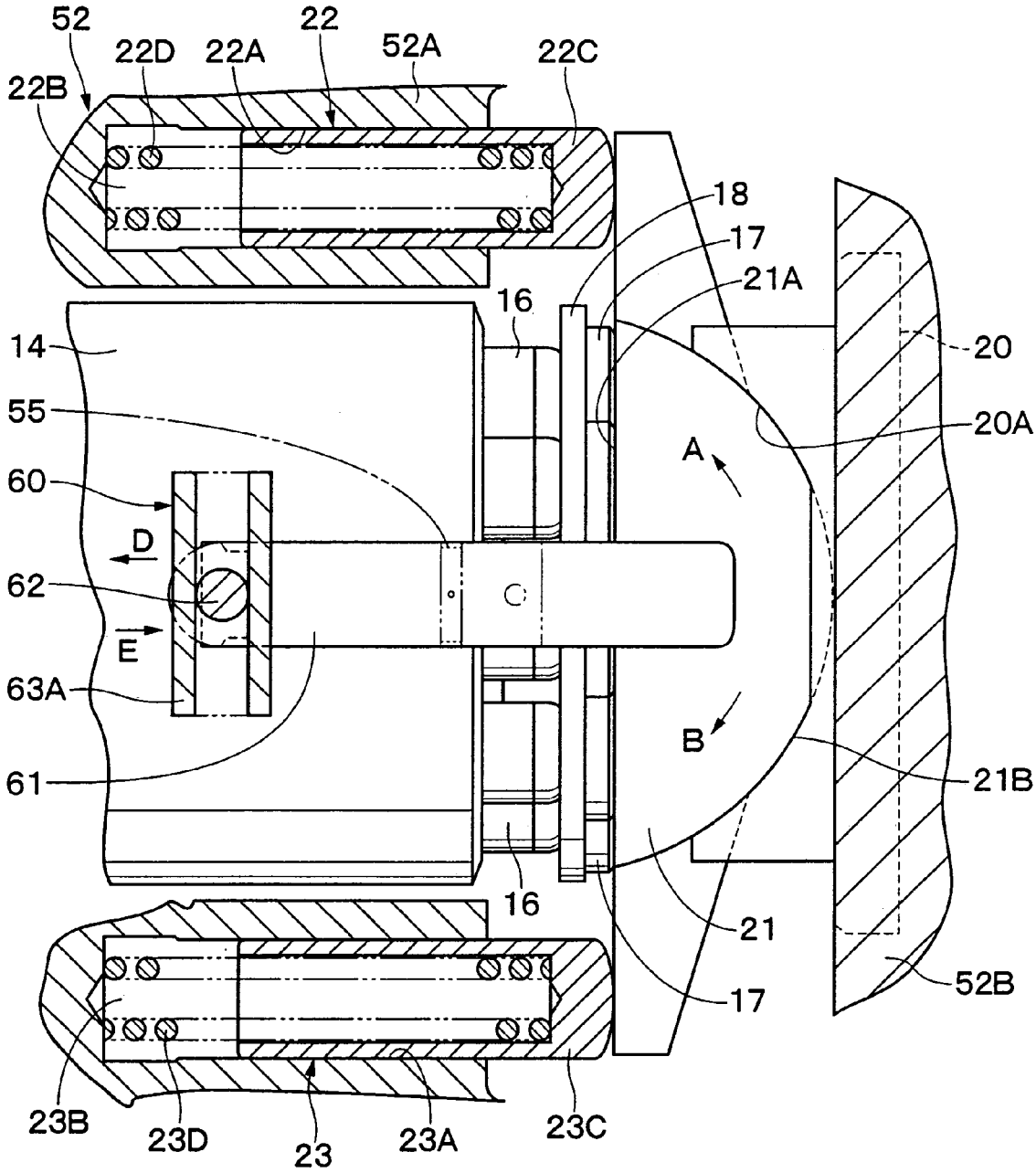
FIG. 11 is an enlarged sectional view taken in the direction of arrows XI—XI of FIG. 10, showing a swash plate in a neutral position.

As shown in FIG. 10, tilting control pressure inlet/outlet ports 54A and 54B are provided in the valve housing 54 of the regulator 53. The inlet/outlet port 54A is connected to the discharge side of the pilot pump 35 through the control conduit 37A, while the inlet/outlet port 54B is connected to the control conduit 37B. The valve housing 54 of the regulator 53 fixed liquid-tight on the outer side of the casing 52, and the control sleeve 55 and spool 56 are disposed to extend in parallel relation with the rotational shaft 13 (in the direction of axis line O—O in FIG. 13).

However, in this case, the regulator 53 has the hydraulic pilot portion 57 and valve spring 58 located positions which are reversed in the axial direction as compared with the counterparts in the first embodiment, and the control sleeve 55 and spool 56 are put in a sliding displacement in an inverse direction. Plunger 57A of the hydraulic pilot portion 57 receives a command pressure from a command pressure conduit 42 as a pilot pressure. According to the received pilot pressure, the spool 56 of the hydraulic pilot portion 57 is put in a sliding displacement in an axial direction (a direction inverse to the sliding displacement in the first embodiment) within the valve housing 54 to switch the regulator 53 from a neutral position (Va) to a switched position (Vb) or (Vc).

Indicated at 59 is a feedback mechanism according to the second embodiment. This feedback mechanism 59 plays a role of feedback control of the regulator 53, following tilting motions of the swash plate 21. In this instance, the feedback mechanism 59 is arranged substantially in the same manner as the feedback mechanism 30 in the first embodiment, and provided with a motion converting section 60 and a translation bar 63 which will be described hereinafter. However, in this case, the feedback mechanism 59 differs from the counterpart in the first embodiment in that it employs a tilting lever 61 which will be described later.

Denoted at 60 is a motion converting section of the feedback mechanism 59. As shown in FIG. 10, the motion converting section 60 is constituted by a tilting lever 61, projection 62 and slider portion 63A, which will be described hereinafter. By the motion converting section 60, a tilting motion of the swash plate 21 is converted into an axial displacement along the axis line O—O of the rotational shaft 13.

Indicated at 61 is a tilting lever which is provided at a lateral side of the swash plate 21. As shown in FIG. 10, this tilting lever 61 is extended along a lateral side of the swash plate 21 and outer periphery of the cylinder block 14 in parallel relation with the rotational shaft 13. The tilting lever 61 is tilted together with the swash plate 21, and has a function of magnifying an axial displacement of the motion converting section 60 (e.g., distances a1 and b1 shown in FIGS. 15 and 16) which will be described in greater detail hereinafter.

Figure 13:
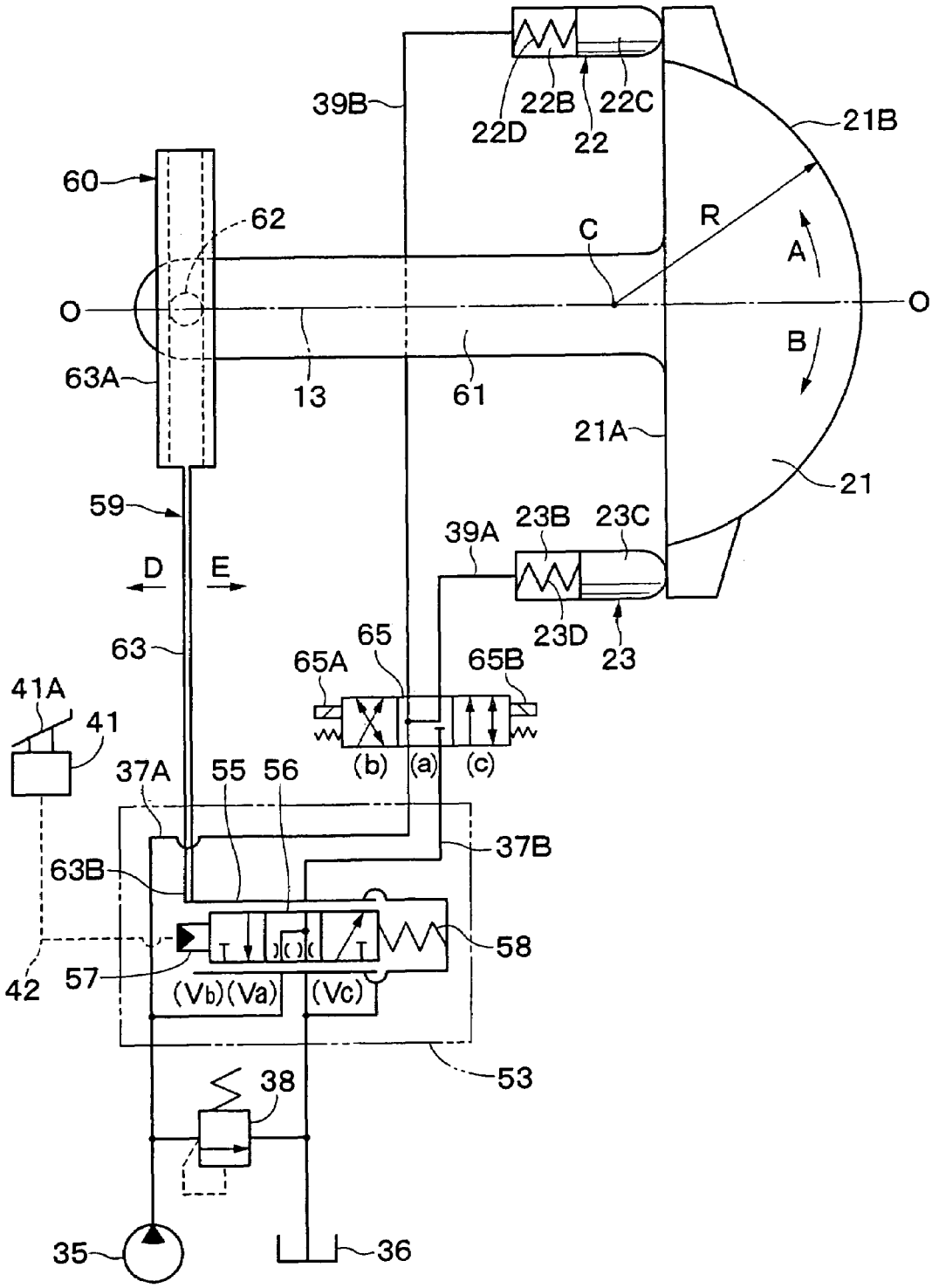
FIG. 13 is a circuit diagram of a tilting controller for the swash plate in the second embodiment.
Figure 14:
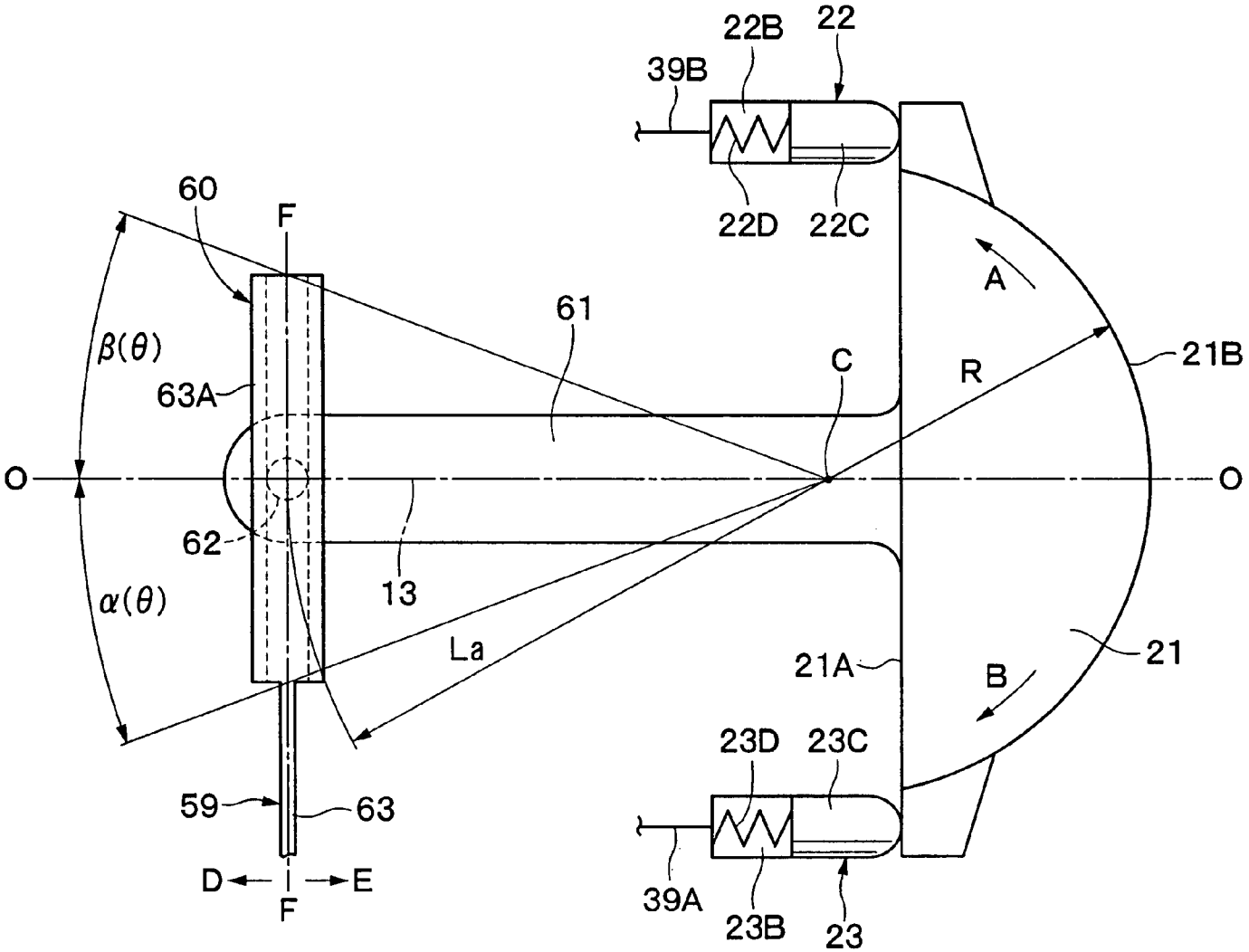
FIG. 14 is a front view showing the swash plate and feedback mechanism of FIG. 13 along with the tilting pistons.

Indicated at 62 is a projection which is fixedly provided on a fore end portion of the tilting lever 61 as an active coupling member. The projection 62 is formed in a round columnar shape by the use of a bolt or pin which is planted on a fore end portion of the tilting lever 61. When the swash plate 21 (the tilting lever 61) is in a zero angle neutral position as shown in FIGS. 13 and 14, the projection 62 is located in a perpendicularly intersecting position relative to the axis line O—O of the rotational shaft 13. Further, as shown in FIG. 14, the projection 62 is located at a distance La from the tilting center C of the swash plate 21, the distance La being larger than the radius R of the tilting guide surface 21B (La>R).

Indicated at 63 is a translation bar which functions as a translation member constituting a displacement transmission member of the feedback mechanism 59. This translation bar 63 is arranged substantially in the same way as the translation bar 33 in the foregoing first embodiment. However, in this case, the translation bar 63 is provided between a fore end portion of the tilting lever 61 and the control sleeve 55 of the regulator 53.

Further, the translation bar 63 is slidably fitted in the slot 52D in the main casing 52A through a guide member 64, which will be described hereinafter, and put in a rectilinear movement along an axial direction of the rotational shaft 13 (along the axis line O—O shown in FIG. 13). As shown in FIG. 10, between a fore end portion of the tilting lever 61 and the control sleeve 55, the translation bar 63 is extended through the casing 52 in the radial direction of the rotational shaft 13 (cylinder block 14).

In this instance, one longitudinal end of the translation bar 63 formed into a U-shaped slider portion 63A, which constitutes a motion converting section 60 together with the projection 62 on the side of the tilting lever 61. As shown in FIG. 13, the slider portion 63A as a passive coupling member is extended in a direction perpendicular to the axis line O—O of the rotational shaft 13, and slidably engaged with the projection 62 on the part of the tilting lever 61.

When the swash plate 21 is in a neutral position, the slider portion 63A of the translation bar 63 is located in an initial position of FIG. 14 together with the projection 62 on the side of the tilting lever 61, namely, located on line F—F which perpendicularly intersects the axis line O—O of the rotational shaft 13. At this time, the translation bar 63 is located in a most receded position in the direction of arrow D in FIG. 13 along the axis line O—O of the rotational shaft 13.

Figure 12:
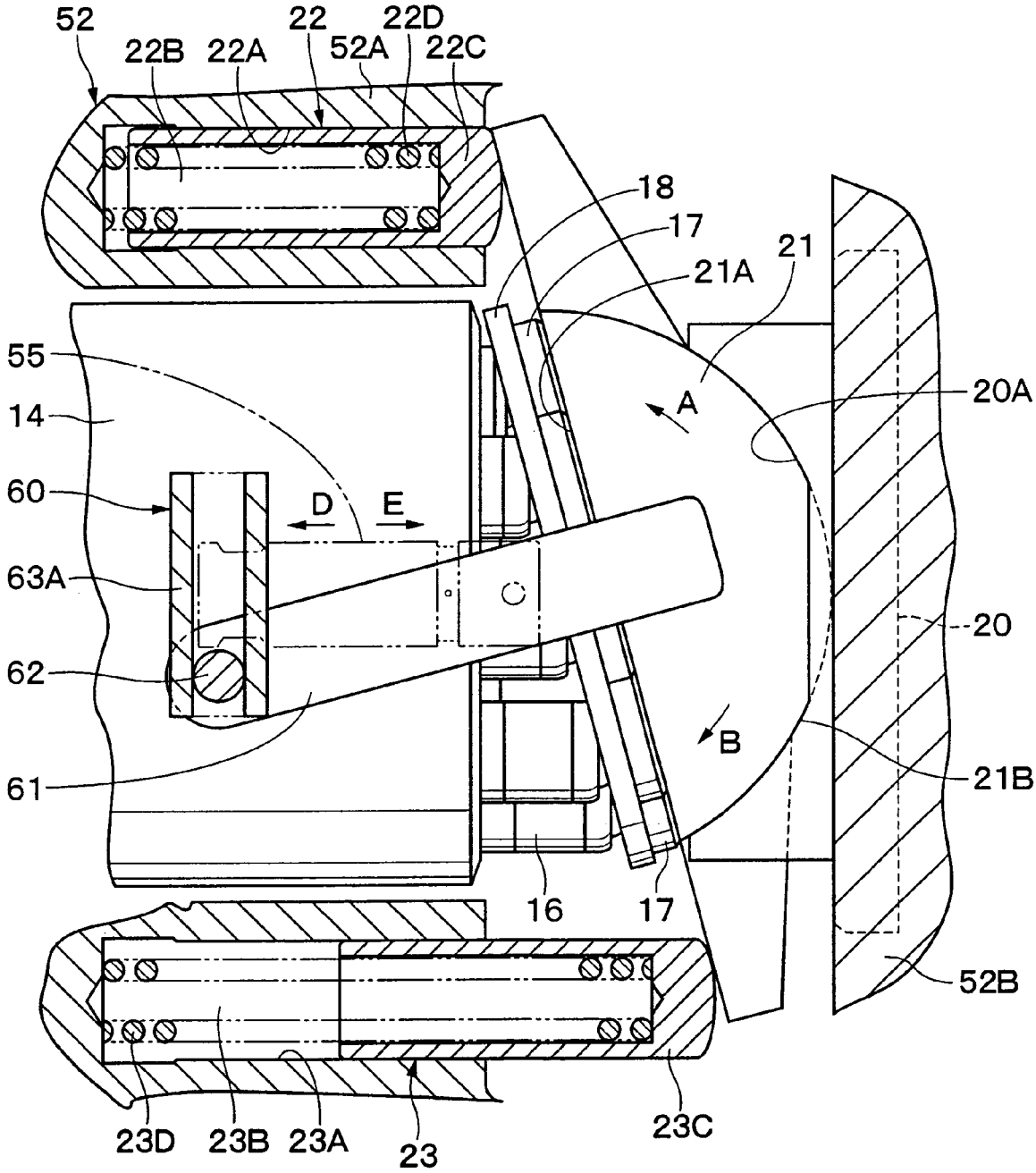
FIG. 12 is a sectional view taken in the same position as FIG. 11, showing the swash plate which has been tilted in a forward direction.
Figure 15:
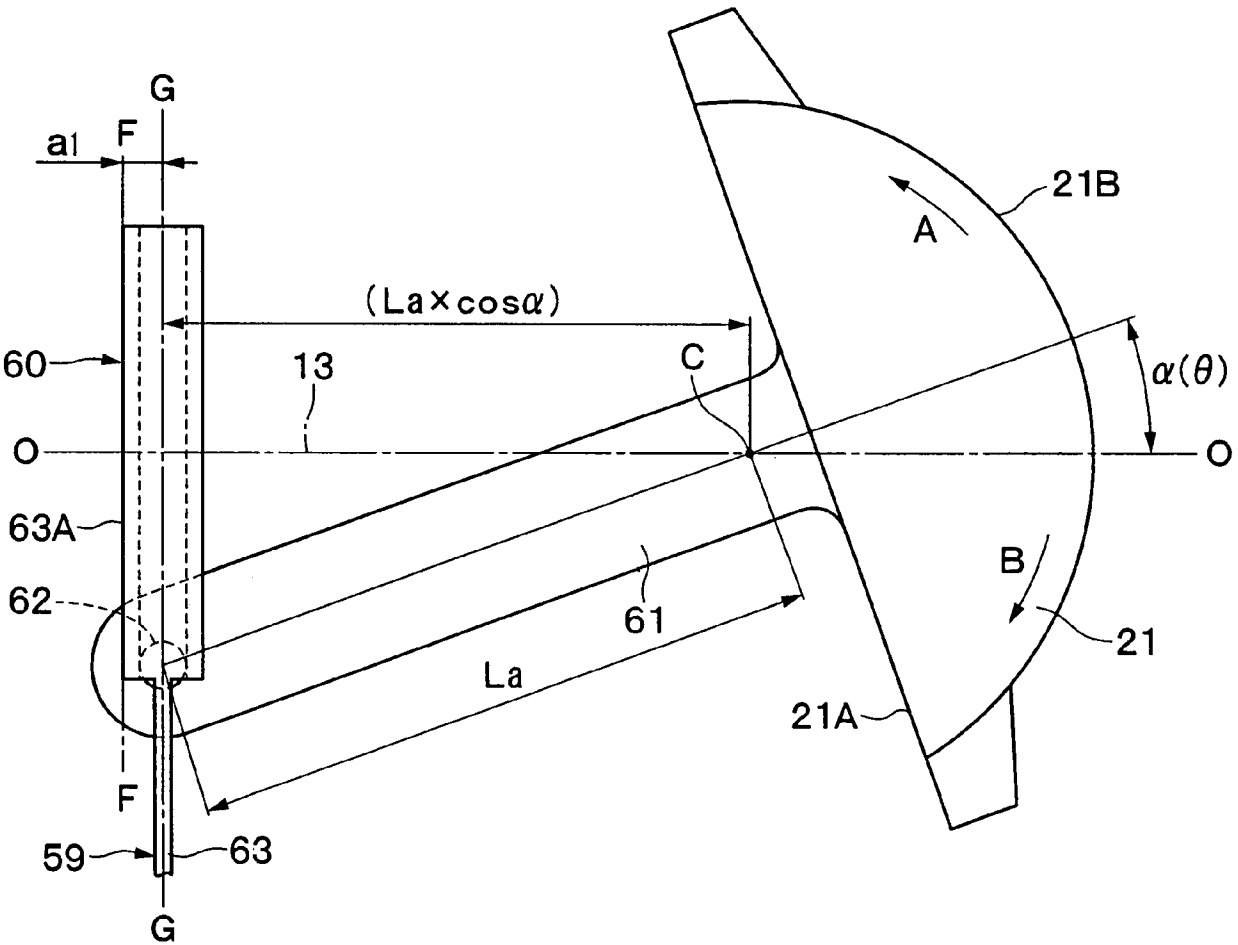
FIG. 15 is a front view showing the swash plate of FIG. 14 which has been tilted in a forward direction.
Figure 16:
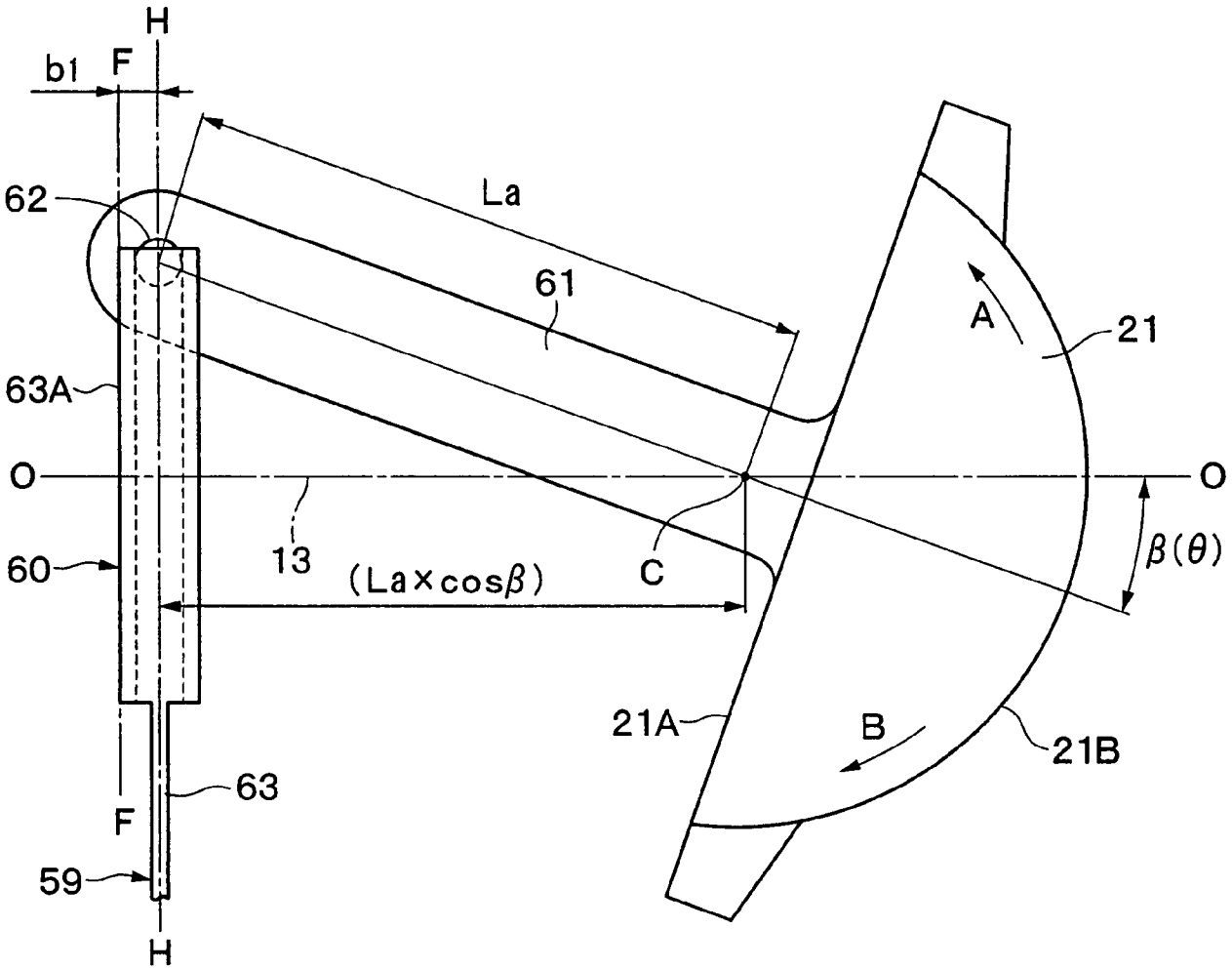
FIG. 16 is a front view showing the swash plate of FIG. 14 which has been tilted in a reverse direction.

When the swash plate 21 is tilted in the direction of arrow A (forward direction) together with the tilting lever 61 from the neutral position to a tilted position where the tilt angle θ is an angle α (θ=α) as shown in FIGS. 12 and 15, the projection 62 on the tilting lever 61 is turned to the position of the angle a relative to the axis line O—O. As a result, following the movement of the projection 62, the slider portion 63A of the translation bar 63 is put in a parallel movement (a rectilinear movement) to a position on line G—G in FIG. 15, which is displaced by a distance a1 in the axial direction of the rotational shaft 13 from the initial position on line F—F.

$$a1=La\times(1-\cos\alpha) \tag{3}$$

On the other hand, when the swash plate 21 is tilted together with the tilting lever 61 in the direction of arrow B (reverse direction) from the neutral position to a position where the tilt angle θ is an angle β (θ=β), the projection 62 on the tilting lever 61 is turned to the position of the angle β relative to the axis line O—O. As a result, following the movement of the projection 62, the slider portion 63A of the translation bar 63 is put in a parallel movement to a position on line H—H in FIG. 16, which is displaced by a distance b1 from the initial position on line F—F in the axial direction of the rotational shaft 13.

$$b1=La\times(1-\cos\beta) \tag{4}$$

In this manner, by the motion converting section 60, which is constituted by the projection 62 on the side of the tilting lever 61 and the slider portion 63A of the translation bar 63, a tilting motion of the swash plate 21 with the tilting lever 61 in the forward or reverse direction is converted into an axial displacement along the axis line O—O of the rotational shaft 13 (e.g., a distance of a1 or b1 mentioned above). This displacement is transmitted to the control sleeve 55 by the translation bar 63 as a similar axial displacement.

Further, the other longitudinal end of the translation bar 63 is extended radially direction toward the control sleeve 55 and provided with a bifurcated anchor portion 63B at the distal end which is arranged to hold the control sleeve 55 from radially outer sides. The anchor portion 63B is securely fixed to outer periphery of the control sleeve 55 by means of a plural number of set screws or rivets. In so doing, the translation bar 63 is fixed and retained at a predetermined angle with the control sleeve 55 (e.g., perpendicularly at 90 degrees). By the translation bar 63, the control sleeve 55 is displaced in the directions of arrows D and E along the rotational shaft 13 (the axis line O—O).

Indicated at 64 is a guide member which is provided to lo cover the slot 52D of the casing 52 shown in FIG. 10. This guide member 64 is arranged to slidably support an longitudinally intermediate portion of the translation bar 63, preventing vibrations and saccadic movements of the translation bar 63 in upward and downward directions (e.g., in the circumferential direction of the cylinder block 14), ensuring smooth parallel movements (rectilinear movements) of the translation bar 63 in the axial direction of the rotational shaft 13.

Designated at 65 is a forward/reverse directional control valve which is provided as a directional control valve between the control conduits 37A and 37B and the control conduits 39A and 39B. As shown in FIGS. 10 and 13, this forward/reverse directional control valve 65 is provided with solenoids 65A and 65B at right and left axial ends, respectively. Further, the forward/reverse directional control valve 65 is manually switched by an operator from a stop position (a) to a forward drive position (b) or a reverse drive position (c), and operates substantially in the same manner as the forward/reverse directional control valve 40 in the first embodiment.

Thus, also in the case of the second embodiment with arrangements as described above, when the swash plate 21 is tilted in the direction of arrow A or B in FIG. 13, the translation bar 63 is put in a parallel movement in the axial direction of the rotational shaft 13 (in the direction of arrow E), following a tilting motion of the swash plate 21 and tilting lever 61. The parallel movement of the translation bar 63 is directly transmitted to the control sleeve 55 of the regulator 53 through the anchor portion 63B for feedback control of the regulator 53, producing substantially the same operational effects as in the foregoing first embodiment.

However, in the case of the present embodiment, the tilting lever 61 which is tiltable together with the swash plate 21 is employed. Consequently, as shown in FIG. 14, the projection 62 can be located at a position which is at a greater distance La (La>R) from the tilting center C of the swash plate 21, for the purpose of magnifying the distance a1 and b1 in Equations 3 and 4 (distances of axial displacements of the translation bar 63) by way of the distance La.

Accordingly, when the spool 56 of the regulator 53 is put in a large sliding displacement in the axial direction by a pilot pressure (a command signal) from the vehicle operating valve 41, the dimension of feedback control (the distance of axial displacement) of the control sleeve 55 can be magnified to a larger scale to provide a stabilized feedback control of the control sleeve 55 of the regulator 53.

Now, turning to FIGS. 17 to 20, there is shown a third embodiment of the present invention. In short, this embodiment has features in that a rocking link is employed for transmitting a tilting motion of a swash plate to a control sleeve of a regulator. In the following description of the third embodiment, those component parts which are identical with the counterparts in the foregoing first embodiment are simply designated by the same reference numerals or characters to avoid repetitions of same explanations.

In the drawings, indicated at 71 is a swash plate type variable displacement hydraulic pump employed in the present embodiment, and at 72 is a casing of the hydraulic pump 71. The casing 72 is built substantially in the same manner as the casing 11 in the foregoing first embodiment. Namely, the casing 72 is constituted by a tubular main casing 72A, a front casing 72B, a rear casing 72C, a slot 72D and a drain passage 72E.

Figure 17:
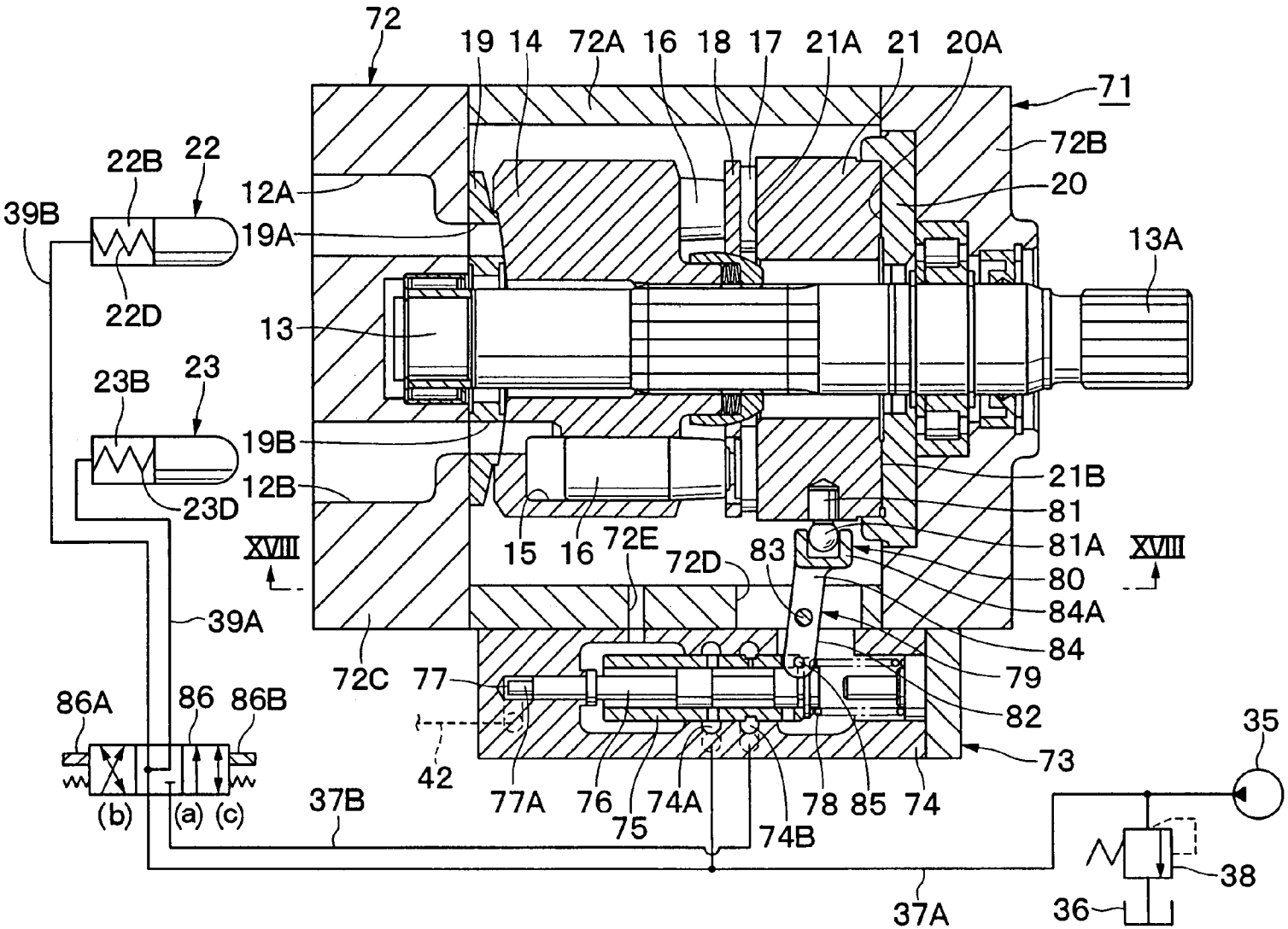
FIG. 17 is a vertical sectional view taken in the same position as FIG. 3, showing a hydraulic pump according to a third embodiment of the invention.
Figure 18:
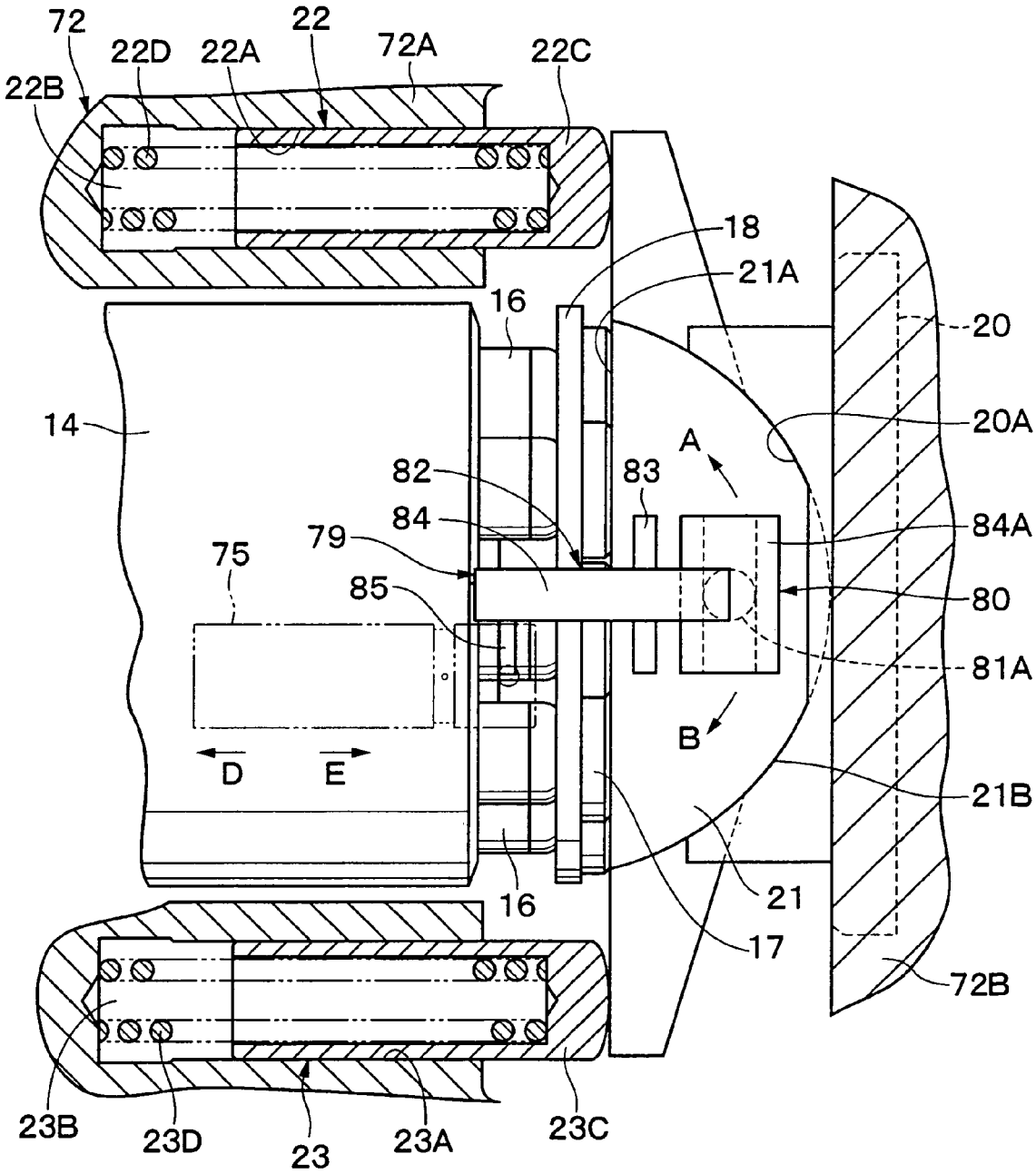
FIG. 18 is an enlarged sectional view taken in the direction of arrows XVIII—XVIII of FIG. 17, showing a swash plate in a neutral position.
Figure 19:
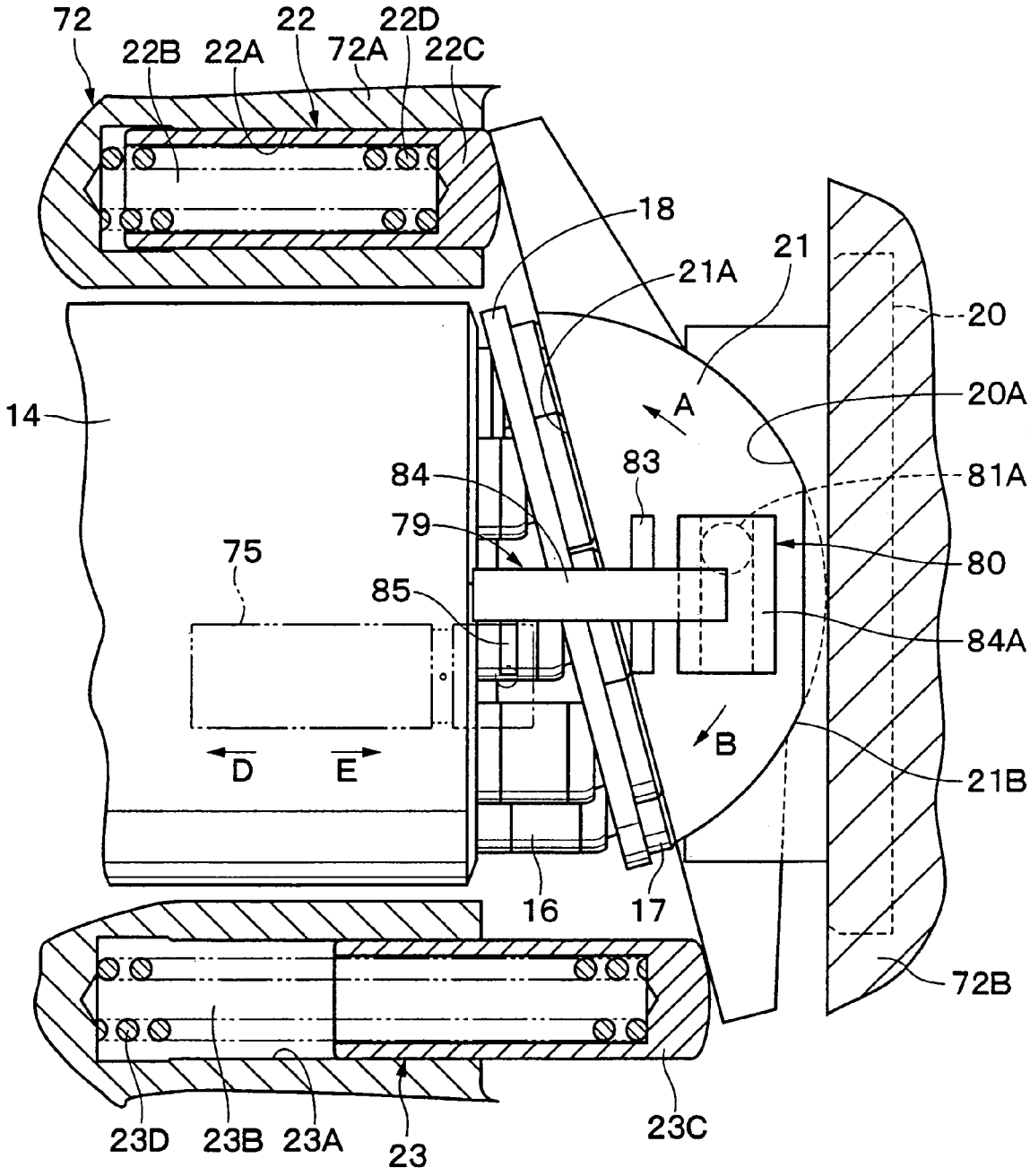
FIG. 19 is a sectional view taken in the same position as FIG. 18, showing the swash plate which has been tilted in a forward direction.

However, in this case of the casing 72, a rocking link 84, described hereinafter, is pivotally supported in the slot 72D through the support shaft 83 as shown in FIG. 17. The inner cavity of the casing 72 forms a drain chamber which is connected to the tank 36.

Indicated at 73 is a regulator which operates as a volume control valve for supplying tilting control pressures to and from tilting actuators 22 and 23. The regulator 73 is constructed substantially in the same manner as the regulator 24 in the foregoing first embodiment. As shown in FIG. 17, the regulator 73 is constituted by a valve housing 74 which is provided on the casing 72, more specifically, on the outer side of the main casing 72A, a control sleeve 75 which is provided within the valve housing 74, a spool 76, a hydraulic pilot portion 77 and a valve spring 78.

As shown in FIG. 17, the valve housing 74 of the regulator 73 is provided with tilting control pressure inlet/outlet ports 74A and 74B, of which the inlet/outlet port 74A is connected to the discharge side of the pilot pump 35 through the control conduit 37A while the inlet/outlet port 74B is connected to the control conduit 37B. Further, the valve housing 74 of the regulator 73 is fixed liquid-tight on an outer side of the casing 72, with the control sleeve 75 and the spool 76 disposed parallel with the rotational shaft 13 (the axis line O—O shown in FIG. 20).

However, in this case, the hydraulic pilot portion 77 and the valve spring 78 of the regulator 73 are located in inversed positions as compared with the counterparts in the first embodiments. Accordingly, the control sleeve 75 and the spool 76 are each put in a sliding displacement in an inverse direction. Further, as a pilot pressure, the plunger 77A of the hydraulic pilot portion 77 receives a command pressure from the command pressure conduit 42. Thus, according to the pilot pressure, the spool 76 is put in a sliding displacement in the axial direction (in the opposite direction as compared with the first embodiment) within the hydraulic pilot portion 77 to switch the regulator 73 of FIGS. 17 and 20 from a neutral position (Va) to a switched position (Vb) or (Vc).

Indicated at 79 is a feedback mechanism according to the third embodiment. This feedback mechanism 79 plays the role of feedback control of the regulator 73, following tilting motions of the swash plate 21. In this instance, the feedback mechanism 79 is arranged substantially in the same way as the feedback mechanism 30 in the foregoing first embodiment, and provided with a motion converting section 80 and a rocking link 84 which will be described hereinafter. However, in this case, the feedback mechanism 79 differs from the counterpart in the first embodiment in that it employs the rocking link 84 which is rockable about a support shaft 83 as described hereinafter.

Denoted at 80 is a motion converting section of the feedback mechanism 79. By this motion converting section 80, a tilting motion of the swash plate 21 is converted into an axial displacement along the axis line O—O of the rotational shaft 13. In this case, the motion converting section 80 is constituted by a coupling pin 81 which is fixedly provided at a lateral side of the swash plate 21 as an active coupling member, and a slider portion 84A which is provided on the rocking link 64 as passive coupling member, as described hereinafter. A spherical projection 81A is provided at the projected distal end of the coupling pin 81.

Indicated at 82 is a displacement transmission member of the feedback mechanism 79, which is constituted by a support shaft 83 which is provided in the slot 72D in the casing 72 and extended in a direction perpendicular to the axis of the rotational shaft 13, and a rocking link 84 as described below.

Denoted at 84 is a rocking link which constitutes a displacement transmission member 82 together with the support shaft 83. Similarly to the translation bar 33 in the first embodiment, the rocking link 84 is located between a lateral side of the swash plate 21 and the control sleeve 75 of the regulator 73. The rocking link 84, however, differs in that it is rockably supported by the support shaft 83 within the slot 72D in the casing 72.

Namely, as shown in FIG. 17, the rocking link 84 is extended into the casing 72 in the radial direction of the rotational shaft 13 (the cylinder block 14) in such a way as to be located between a lateral side of the swash plate 21 and the control sleeve 75. The rocking link 84 is rockable about the support shaft 83 within the slot 72D of the casing 72 in the directions of arrows J and K in FIG. 20.

Figure 20:
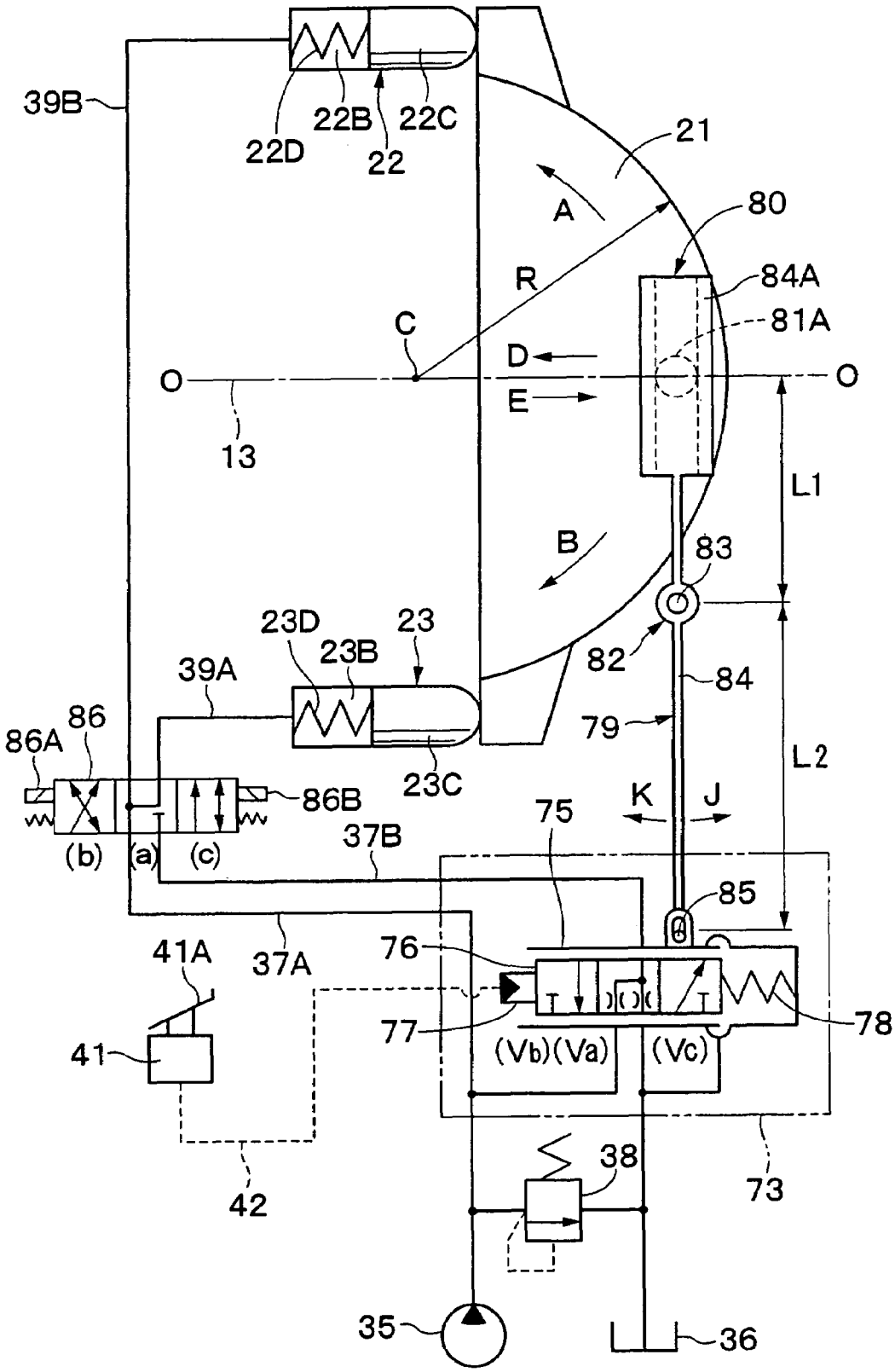
FIG. 20 is a circuit diagram of a tilting controller for the swash plate in the third embodiment.

In this instance, the rocking link 84 is provided with a slider portion 84A of U-shape in cross section at one longitudinal end. This slider portion 84A constitutes the motion converting section 80 together with the projection 81A on the side of the swash plate 21. As shown in FIG. 20, the slider portion 84A is extended in a direction perpendicular to the axis line O—O of the rotational shaft 13, and constitutes a passive coupling member to be held in sliding engagement with the projection 81A.

Further, as shown in FIG. 20, the rocking link 84 is arranged to have a length L1 between the support shaft 83 and the projection 81A, and a length L2 between the support shaft 83 and a connecting pin 85, which will be described later. When the slider portion 84A is put in a rectilinear movement (a parallel movement) in the direction of arrow D or E as described hereinafter, the rocking link 84 on the side of the connecting pin 85 is displaced inversely against the slider portion 84A in the axial direction of the rotational shaft 13 at a rate of (L2/L1).

Namely, as the projection 81A of the coupling pin 81 is tilted together with the swash plate 21 in the direction of arrow A or B from a zero angle of neutral position, the slider portion 84A of the rocking link 84 is put in a rectilinear movement in an axial direction of the rotational shaft 13 (in the direction of axis line O—O in FIG. 20), for example, making an axial displacement in the direction of arrow D. At this time, the other longitudinal end of the rocking link 84 (the side of the connecting pin 85) is rocked in the opposite direction to make a displacement in the direction of arrow J in FIG. 20.

In this manner, by the motion converting section 80, which is constituted by the projection 81A on the side of the swash plate 21 and the slider portion 84A of the rocking link 84, a tilting motion of the swash plate 21 in the forward or reverse-direction is converted into an axial displacement in the direction of axis line O—O of the rotational shaft 13. At this time, the rocking link 84 is turned about the support shaft 83 in the direction of arrow J or K, transmitting an inversed axial displacement to the control sleeve 75 through a connecting pin 85, which will be described hereinafter.

Indicated at 85 is a connecting pin which is adopted to transmit a rocking movement of the rocking link 84 to the control sleeve 75. By this connecting pin 85, the other longitudinal end of the rocking link 84 is pivotally connected to the control sleeve 75. The control sleeve 75 is displaced in the axial direction of the regulator 73 by the connecting pin 85, following the rocking movement of the rocking link 84.

At this time, the axial displacement of the control sleeve 75 is magnified depending upon the ratio of the lengths of hands of the rocking link 84 (L2/L1). The support shaft 83 which pivotally supports a longitudinally intermediate portion of the rocking link 84 also serves to suppress vibratory or saccadic movements of the rocking link 84 in upward and downward directions (e.g., in the circumferential direction of the cylinder block 14), ensuring smooth rocking displacements of the rocking link 84.

Denoted at 86 is a forward/reverse directional control valve which is provided as a directional control valve between the control conduits 37A and 37B and the control conduits 39A and 39B. As shown in FIGS. 17 and 20, this forward/reverse directional control valve 86 is provided with solenoids 86A and 86B at right and left axial ends, respectively. Further, lo this forward/reverse directional control valve 86 is manually switched by an operator from a stop position (a) to a forward drive position (b) or a reverse drive position (c), and operates substantially in the same manner as the forward/reverse directional control valve 40 in the foregoing first embodiment.

Thus, in the case of the present embodiment with the arrangements as described above, when the swash plate 21 is tilted in the direction of arrow A or B in FIG. 20, the slider portion 84A of the rocking link 84 is also put in a parallel movement in the axial direction of the rotational shaft 13 (in the direction of arrow D) following a tilting motion of the swash plate 21.

At this time, the rocking link 84 is turned about the support shaft 83 in the direction of arrow J, and this rocking displacement is transmitted to the control sleeve 75 of the regulator 73 through the connecting pin 85, producing substantially the same operational effects as the foregoing first embodiment in terms of feedback control of the regulator 73.

However, in the case of the present embodiment, the rocking link 84 is rockably mounted on the support shaft 83 between the swash plate 21 and the control sleeve 75. Therefore, as shown in FIG. 20, a tilting displacement of the swash plate 21 is transmitted to the control sleeve 75 on a magnified scale according to the ratio (L2/L1) of the lengths of the hands of the rocking link 84, that is, a ratio of the length L1 of one hand extending from the support shaft 83 to the projection 81A to the length L2 of the other hand extending from the support shaft 83 to the connecting pin 85.

Thus, even when the spool 76 of the regulator 73 is put in a sliding displacement largely in the axial direction by a pilot pressure (a command signal) from the vehicle operating valve 41, the distance of feedback control of the control sleeve 75 (the distance of axial displacement) is enlarged to provide a stabilized feedback control for the control sleeve 75 of the regulator 73.

Figure 21:
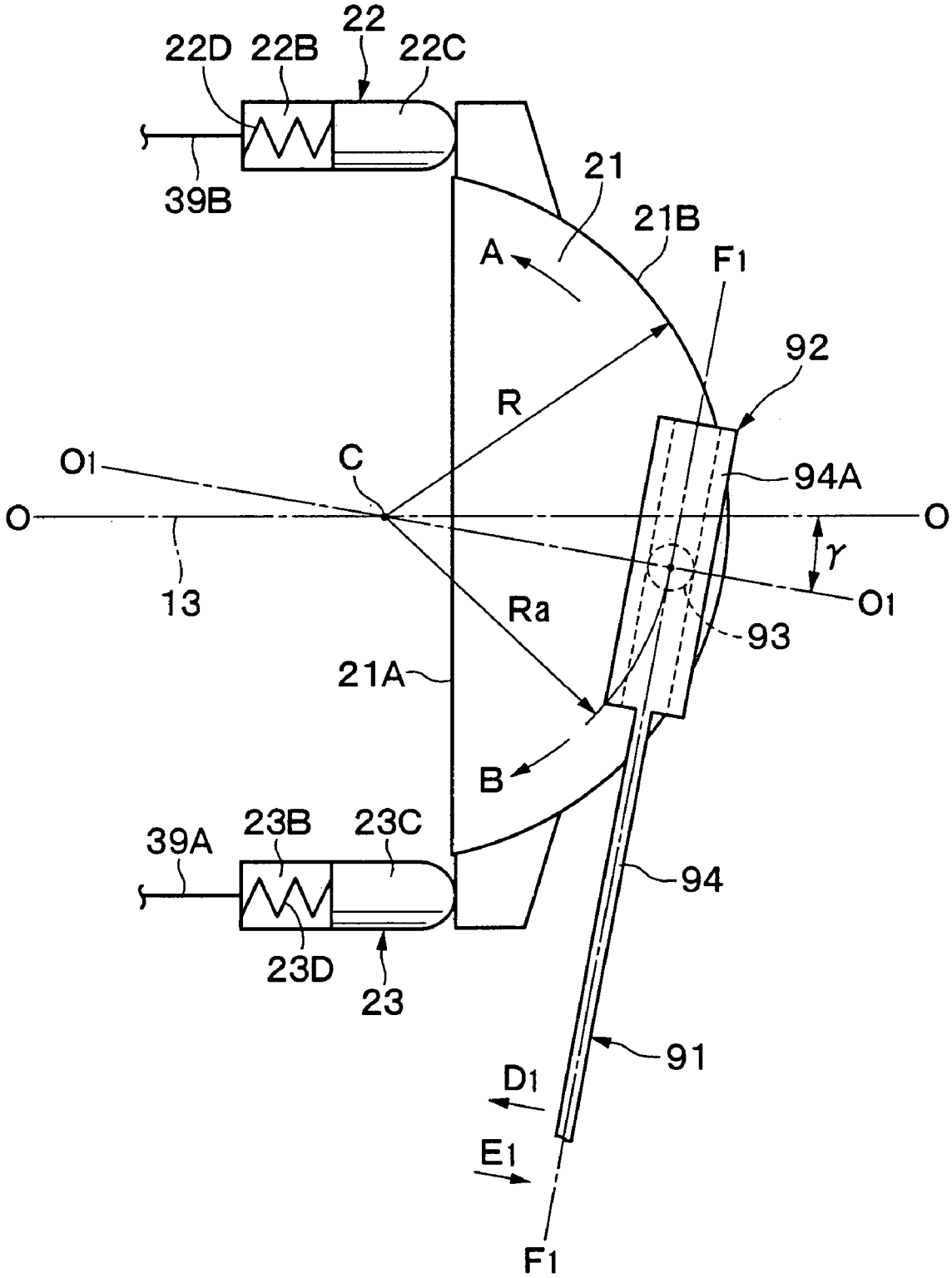
FIG. 21 is a front view showing, along with a tilting piston, a swash plate and a feedback mechanism of a tilting controller according to a fourth embodiment of the invention.
Figure 22:
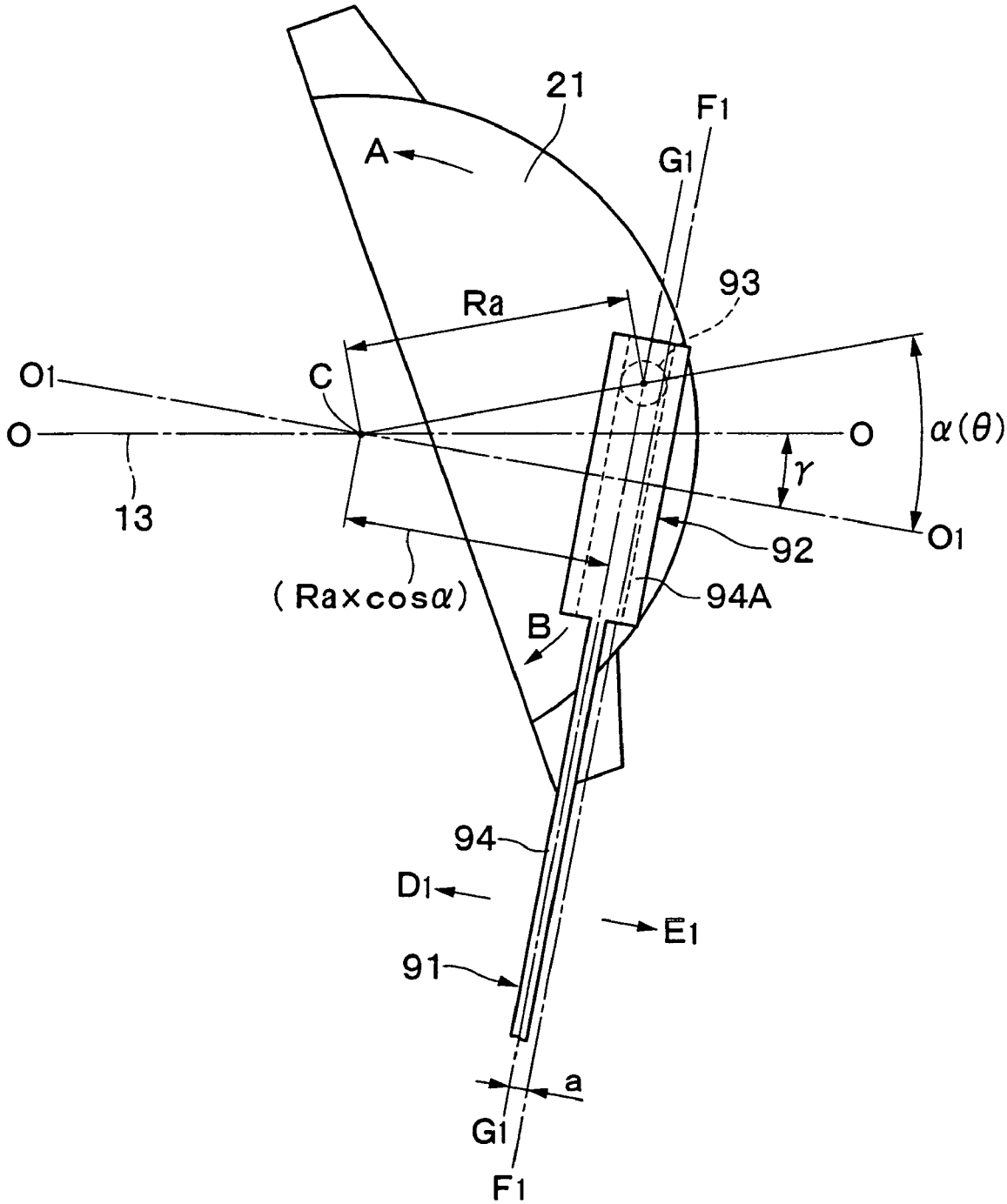
FIG. 22 is a front view showing the swash plate of FIG. 21 which has been tilted in a forward direction.
Figure 23:
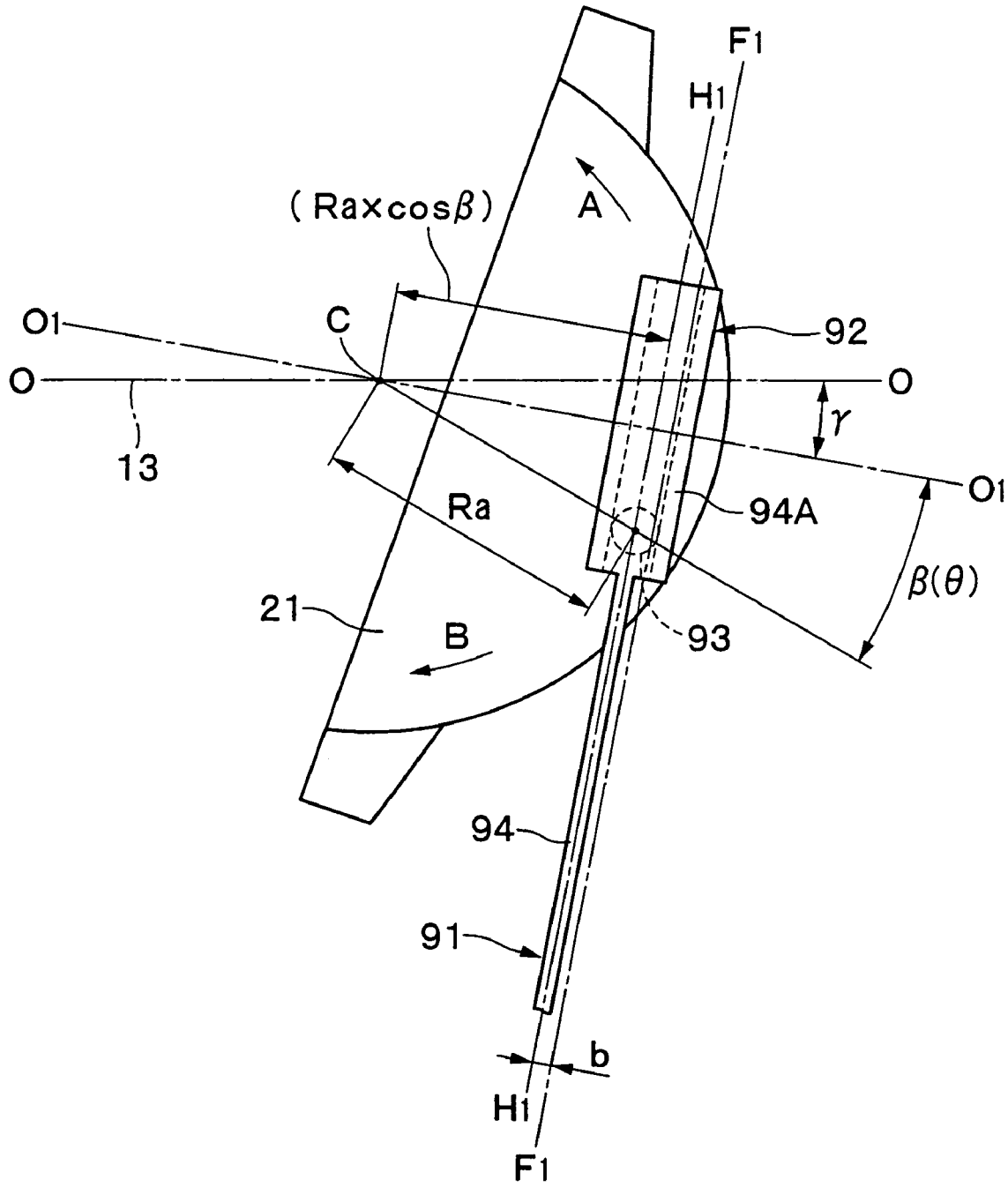
FIG. 23 is a front view showing the swash plate of FIG. 21 which has been tilted in a reverse direction.

Now, turning to FIGS. 21 to 23, there is shown a fourth embodiment of the present invention. This embodiment has features in that a translation bar is put in a rectilinear movement along a straight line which is inclined relative to the axis line of the rotational shaft, converting a tilting motion of the swash plate into a longitudinal linear displacement along the inclined straight line. In the following description of the fourth embodiment, those component parts which are identical with the counterparts in the foregoing first embodiment are simply designated by the same reference numerals or characters to avoid repetitions of same explanations.

In the drawings, indicated at 91 is a feedback mechanism adopted in the fourth embodiment. This feedback mechanism 91 is arranged substantially in the same way as the feedback mechanism 30 in the first embodiment, and provided with a motion converting section 92 and a translation bar 94 as will be described hereinafter. However, in this case, the feedback mechanism 91 differs from the first embodiment in that the translation bar 94, which will be described later, is put in a rectilinear movement (a parallel movement) along an inclined straight line O1—O1.

In this instance, as shown in FIGS. 21 to 23, the inclined straight line O1—O1 is a straight line which passes through the tilting center C of the swash plate 21, and inclined through a predetermined angle γ relative to the axis line O—O of the rotational shaft 13. The angle γ may be either a positive angle or a negative angle. Namely, as shown in FIG. 21, the inclined straight line O1—O1 may be a straight line which is inclined through an angle γ in the direction of arrow B relative to the axis line O—O of the rotational shaft 13 or a straight line which is inclined through an angle γ in the direction of arrow A relative to the axis line O—O of the rotational shaft 13.

Indicated at 92 is a motion converting section of the feedback mechanism 91. Similarly to the motion converting section 31 in the foregoing first embodiment, this motion converting section 92 is constituted by a projection 93 and a slider portion 94A, which will be described hereinafter. However, in the case of the motion converting section 92, a tilting motion of the swash plate 21 is converted into a longitudinal linear displacement along the inclined straight line O1—O1.

Denoted at 93 is a projection which is fixedly provided at a lateral side of the swash plate 21 as an active coupling member. This projection 93 is arranged substantially in the same way as the projection 32 in the first embodiment, and located at a distance Ra from the tilting center C of the swash plate 21. However, as shown in FIG. 21, when the swash plate 21 is in a zero angle neutral position, the projection 93 is located in a perpendicularly intersecting position relative to the inclined straight line O1—O1.

Indicated at 94 is a translation bar, i.e., a translating member in a displacement transmission member of the feedback mechanism 91. This translation bar 94 is arranged substantially in the same way as the translation bar 33 in the first embodiment. However, the translation bar 94 differs from the translation bar 33 of the first embodiment in that it is extended in a direction approximately perpendicularly intersecting the inclined straight line O1—O1.

In this instance, the translation bar 94 is provided with a slider portion 94A of U-shape in cross section at one longitudinal end to constitute a motion converting section 92 in cooperation with the projection 93 on the side of the swash plate 21. As shown in FIG. 21, the slider portion 94A as a pressure coupling member is extended in a perpendicularly intersecting direction relative to the inclined straight line O1—O1, and slidably engaged with the projection 93 on the side of the swash plate 21.

When the swash plate 21 is in the neutral position, the slider portion 94A of the translation bar 94 is located in an initial position of FIG. 21 together with the projection 93, on line F1—F1 which perpendicularly intersects the inclined straight line O1—O1. At this time, the translation bar 94 is located in a most receded position in the direction of arrow E1 in FIG. 21 along the inclined straight line O1—O1.

Further, when the swash plate 21 in the neutral position is tilted in the direction of arrow A (in the forward direction) to a position where the tilt angle $\theta$ is an angle $\alpha$ ($\theta=\alpha$), the projection 93 on the swash plate 21 is turned to a position of angle $\alpha$ relative to the inclined straight line O1—O1 as shown in FIG. 22. Therefore, following the movement of the projection 93, the slider portion 94A of the translation bar 94 is put in a parallel movement (a rectilinear movement) as far as a position on line G1—G1 of FIG. 22, which is displaced by a distance a (see Equation 1) from the initial position on line F1—F1 in the longitudinal direction of the inclined straight line O1—O1.

On the other hand, when the swash plate 21 in the neutral position is tilted in the direction of arrow B (in the reverse direction) to position where the tilt angle $\theta$ is an angle $\beta$ ($\theta=\beta$), the projection 93 on the swash plate 21 is turned to a position of the angle $\beta$ relative to the inclined straight line O1—O1 as shown in FIG. 23. Therefore, following the movement of the projection 93, the slider portion 94A of the translation bar 94 is put in a parallel movement as far as the position on line H1—H1 of FIG. 23, which is displaced by a distance b from the initial position on line F1—F1 in the longitudinal direction of the inclined straight line O1—O1.

In this manner, by the motion converting section 92 which is constituted by the projection 93 on the side of the swash plate 21 and the slider portion 94A of the translation bar 94, a tilting motion of the swash plate 21 in the forward or reverse direction is converted into a longitudinal linear displacement along the inclined straight line O1—O1 (e.g., a displacement of a distance a or b). By the translation bar 94, this displacement is transmitted to the control sleeve 26 (see FIG. 6) as a similar longitudinal linear displacement.

Thus, in the case of the present embodiment with the arrangements as described above, when the swash plate 21 is tilted in the direction of arrow A or B of FIG. 21, the slider portion 94A of the translation bar 94 is put in a parallel movement following the tilting movement of the swash plate 21, in the direction of arrow D1 or E1 along the inclined straight line O1—O1, producing substantially the same operational effects as in the foregoing first embodiment.

Figure 24:
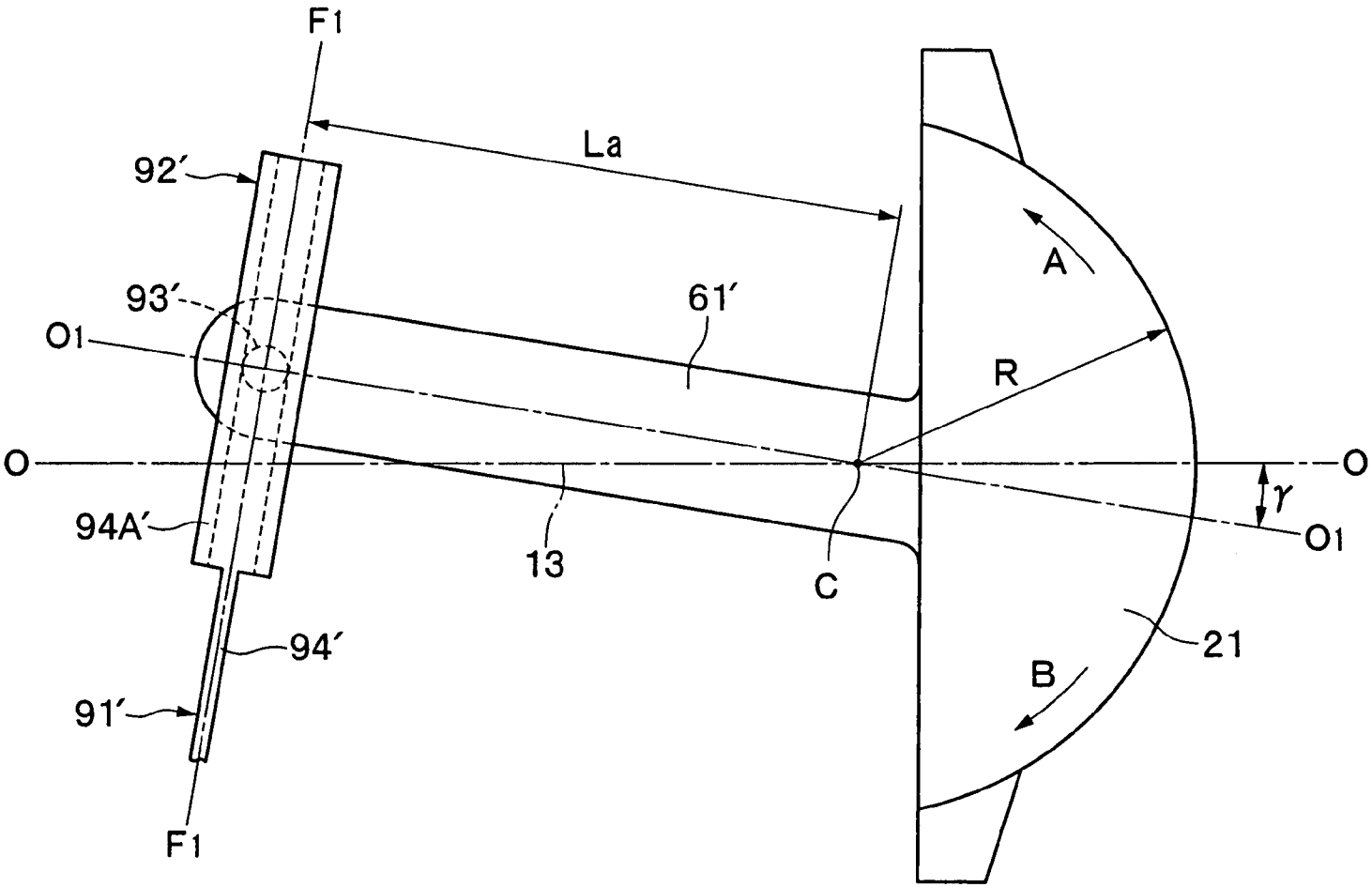
FIG. 24 is a front view showing a swash plate and a feedback mechanism in a modification of the tilting controller.

In the fourth embodiment described above, by way of example the projection 93 of the motion converting section 92 is provided on a lateral side of the swash plate 21. However, it is to be understood that the present invention is not limited to the particular arrangements shown. For example, as in a modification shown in FIG. 24, a motion converting section 92' of a feedback mechanism 91' may be located at a position which is spaced from a lateral side of the swash plate 21.

In this instance, the motion converting section 92' is constituted by a tilting lever 61' which is extended from a lateral side of the swash plate 21 along an inclined straight line O1—O1, a projection 93' which is provided on a fore end portion of the tilting lever 61' as an active coupling member, and a slider portion 94A' which is provided on a translation bar 94' as a passive coupling member.

The tilting lever 61' is substantially of the same construction as the tilting lever 61 in the foregoing second embodiment. However, the tilting lever 61' in the modification is differs from the tilting lever 61 in the second embodiment in that it is extended along an inclined straight line O1—O1.

Further, in the foregoing embodiments of the invention, as exemplified in FIG. 6, the vehicle operating valve 41 is employed as an external command means, supplying the regulator 24 (53, 73) with a pilot pressure as a command signal commensurate with the extent of depression of the vehicle drive pedal 41A. However, needless to say, the present invention is not limited to the particular arrangements shown. For example, it is possible to incorporate an electromagnetic proportional solenoid into the hydraulic pilot portion 28 (57, 77) of the regulator 24 (53, 77), in combination with an external command means which is adapted to produce as a command signal an electric signal commensurate with the extent of depression of the vehicle drive pedal 41A.

Further, in the foregoing embodiments, the tilting controller of the swash plate type variable displacement hydraulic pump 1 (51, 71) is applied by way of example to a vehicle drive hydraulic circuit of a wheel type working vehicle like a wheel loader. However, the present invention is applicable to various closed hydraulic circuits other than a vehicle drive hydraulic circuit, for example, to a hydraulic circuit for a swing structure on a working vehicle.

Further, in the foregoing embodiments, the present invention has been described by way of a tilting controller of a swash plate type variable displacement pump 1 (51, 71). However, it is to be understood that application of the present invention is not limited to swash plate type variable displacement pumps. For example, the present invention can also be applied to a bent axis type variable displacement pump in which a volume varying portion is constituted by a valve plate or the like.

Moreover, the present invention can be applied to various working vehicles other than wheel loader. For example, the present invention can also be applied to wheel type hydraulic excavators, wheel type hydraulic cranes, Bulldozers, working vehicles like lift trucks, or crawler type hydraulic excavator.

The invention claimed is:

1. A tilting controller for a variable displacement hydraulic pump, including a variable displacement hydraulic pump having a volume varying portion in association with a rotational shaft rotationally driven by a drive source, tilting actuators adapted to be applied with a tilting control pressure for driving said volume varying portion of said hydraulic pump into a tilted position, a regulator in the form of a servo valve having a spool within a control sleeve for generating said tilting control pressure to be fed to and from said tilting actuators according to a command signal from outside, and a feedback mechanism adapted to follow tilting motions of said volume varying portion to feed back said control sleeve of said regulator, characterized in that:

said volume varying portion of said hydraulic pump is tiltable in both forward and reverse directions from a zero angle neutral position driven by said tilting actuators;

said feedback mechanism is constituted by a motion converting section adapted to convert a tilting motion of said volume varying portion into a longitudinal linear displacement along a straight line passing through a tilting center (C) of said volume varying portion, and a displacement transmission member located between said motion converting section and said control sleeve of said regulator to transmit said longitudinal linear displacement converted by said motion converting section to said control sleeve of said regulator, said displacement transmission member being constituted by a translation member adapted to be put in a rectilinear movement in the longitudinal direction of said straight line together with said control sleeve of said regulator, following a tilting motion of said volume varying portion;

said motion converting section being located in an initial position (F—F, F1—F1) at one end of longitudinal direction along said straight line when said volume varying portion is in a neutral position, and being displaced along and toward the other end of longitudinal direction along said straight line from said initial position (F—F, F1—F1) when said volume varying portion is driven to tilt in forward or reverse direction.

2. A tilting controller for a variable displacement hydraulic pump as defined in claim 1, wherein said straight line extends parallel with an axis line (O—O) of said rotational shaft of said hydraulic pump, and said motion converting section is adapted to convert a tilting motion of said volume varying portion into an axial displacement in the direction of said axis line (O—O) of said rotational shaft.

3. A tilting controller for a variable displacement hydraulic pump as defined in claim 1, wherein said straight line is an inclined straight line (O1—O1) drawn at a predetermined angle relative to said rotational shaft of said hydraulic pump, and said motion converting section is adapted to convert a tilting motion of said volume varying portion into a longitudinal linear displacement in the direction of said inclined straight line (O1—O1).

4. A tilting controller for a variable displacement hydraulic pump as defined in claim 1, wherein a directional control valve is provided between said tilting actuators and said regulator to switch direction of supply of said tilting control pressure for driving to tilt said volume varying portion in forward or reverse direction from a neutral position.

5. A tilting controller for a variable displacement hydraulic pump as defined in claim 1, wherein said motion converting section of said feedback mechanism is constituted by an active coupling member provided at a lateral side of said volume varying portion at a position spaced from a tilting center (C) of said volume varying portion, and a passive coupling member provided at one longitudinal end of said displacement transmission member extended in a perpendicularly intersecting direction relative to said straight line and held in sliding engagement with said active coupling member.

6. A tilting controller for a variable displacement hydraulic pump as defined in claim 5, wherein said active coupling member of said motion converting section is constituted by a projection provided on said volume varying portion to extend in a radial direction relative to said straight line, and said passive coupling member is constituted by a slider portion of U-shape in cross section slidably held in fitting engagement with said projection and extended in a perpendicularly intersecting direction relative to said straight line.

7. A tilting controller for a variable displacement hydraulic pump as defined in claim 1, wherein said motion converting section of said feedback mechanism is constituted by a tilting lever extended from said volume varying portion in the longitudinal direction of said straight line for tilting integrally with said volume varying portion, an active coupling member provided on said tilting lever at a position spaced from a tilting center (C) of said volume varying portion, and a passive coupling member provided at one longitudinal end of said displacement transmission member to extend in a perpendicularly intersecting direction relative to said straight line and held in sliding engagement with said active coupling member.

8. A tilting controller for a variable displacement hydraulic pump as defined in claim 7, wherein said active coupling member of said motion converting section is constituted by a projection provided on said tilting lever in a radial direction relative to said straight line, and said passive coupling member is constituted by a slider portion of U-shape in cross section slidably held in fitting engagement with said projection and extended in a perpendicularly intersecting direction relative to said straight line.

9. A tilting controller for a variable displacement hydraulic pump as defined in claim 1, wherein said control sleeve and spool of said regulator are disposed to extend parallel with said straight line, and said displacement transmission member is fixedly anchored to said control sleeve.

10. A tilting controller for a variable displacement hydraulic pump as defined in claim 1, wherein said hydraulic pump is comprised of a tubular casing rotatably supporting said rotational shaft, a cylinder block provided in said casing for rotation integrally with said rotational shaft and containing a plural number of cylinders which extend in axial direction at spaced positions in circumferential direction, a plural number of pistons fitted in said cylinders of said cylinder block for reciprocating movements therein, and a swash plate having a sliding surface for a shoe attached to an end of each piston and tiltably mounted in said casing to constitute said volume varying portion;

said tilting actuators are located in said casing at a spaced position from said rotational shaft in radially direction and having tilting pistons for driving said swash plate in a neutral position to tilt in a forward or reverse direction;

said regulator is provided in said casing at a spaced position from said tilting pistons, with said control sleeve coupled with said swash plate through said feedback mechanism; and an intermediate portion of said displacement transmission member of said feedback mechanism is mounted on said casing in such a way as to permit displacements along the longitudinal direction of said straight line.

* * * * *